US007455496B2

(12) United States Patent
Motojima et al.

(10) Patent No.: US 7,455,496 B2
(45) **Date of Patent: *Nov. 25, 2008**

(54) TURBINE FUEL PUMP

(75) Inventors: Junichi Motojima, Gunma (JP); Masaaki Iijima, Gunma (JP)

(73) Assignee: Hitachi, Ltd., Tokyo (JP)

( * ) Notice: Subject to any disclaimer, the term of this patent is extended or adjusted under 35 U.S.C. 154(b) by 139 days.

This patent is subject to a terminal disclaimer.

(21) Appl. No.: 11/201,188

(22) Filed: Aug. 11, 2005

(65) Prior Publication Data

US 2007/0086882 A1 Apr. 19, 2007

(51) Int. Cl.
*F01D 1/12* (2006.01)

(52) U.S. Cl. ..... 415/55.1; 415/55.2; 415/55.3; 416/238; 416/DIG. 2

(58) Field of Classification Search ..... 415/55.1–55.7; 416/228, 235, 237, 238, DIG. 2
See application file for complete search history.

(56) References Cited

U.S. PATENT DOCUMENTS

| | | | | |
|---|---|---|---|---|
| 2,042,499 | A * | 6/1936 | Brady | 415/55.4 |
| 5,299,908 | A * | 4/1994 | Robbie | 415/55.1 |
| 5,407,318 | A | 4/1995 | Ito et al. | |
| 5,513,950 | A | 5/1996 | Yu | |
| 5,549,446 | A | 8/1996 | Gaston et al. | |
| 6,190,132 | B1 | 2/2001 | Yamakawa et al. | |
| 6,254,342 | B1 | 7/2001 | Fujinaka et al. | |
| 6,454,522 | B2 * | 9/2002 | Sakamoto et al. | 415/55.1 |
| 6,974,302 | B2 * | 12/2005 | Motojima et al. | 415/55.1 |
| 2001/0028843 | A1 * | 10/2001 | Sakamoto et al. | 415/55.1 |

FOREIGN PATENT DOCUMENTS

| | | |
|---|---|---|
| DE | 43 40 011 A1 | 6/1995 |
| DE | 197 44 237 A1 | 4/1998 |
| JP | 7-189973 (A) | 7/1995 |
| JP | 08-100780 A | 4/1996 |
| JP | 8-100780 (A) | 4/1996 |
| JP | 195 39 909 A1 | 1/1997 |

* cited by examiner

*Primary Examiner*—Theresa Trieu
(74) *Attorney, Agent, or Firm*—Antonelli, Terry, Stout & Kraus, LLP.

(57) ABSTRACT

A turbine fuel pump includes an impeller having blades, each including a linear blade portion extending linearly in the radial direction of the impeller and a curved blade portion extending circularly curvedly from the head of the linear blade portion to the forward side of the impeller as viewed in the direction of rotation of the impeller. The linear blade portion has a length of (⅓ to ⅔)×H, where H is an overall length of the impeller.

7 Claims, 25 Drawing Sheets

TURBINE FUEL PUMP

BACKGROUND OF THE INVENTION

The present invention relates to a turbine fuel pump suitable for use, for example, in fuel supply to an injection valve for an automotive engine.

Typically, the vehicle such as a passenger car is provided with an electronically controlled fuel injection system for supplying fuel to an engine, which comprises an injection valve for injecting fuel to an engine combustion chamber, a fuel pump for delivering to the injection valve fuel within a fuel tank arranged, e.g. in the rear of the vehicle, etc. Recently, because of social requirements of the global environmental protection, there is an increasing demand for an improvement in fuel consumption of the vehicle. Thus, it is an important challenge for the fuel pump driven by an electric motor to achieve an enhancement in efficiency (i.e. reduction in electric power consumption) and a reduction in size and weight.

The fuel pump in general use includes a turbine fuel pump comprising a cylindrical casing for accommodating an electric motor, an upper cover arranged at one end of the casing, a housing arranged at another end of the casing so as to support the motor and having an annular fuel passage between fuel inlet and outlet ports, and an impeller rotatably arranged in the housing and for feeding fuel sucked through the inlet port to the outlet port via the fuel passage while being rotated by the motor.

The impeller is formed like a disc, and has blades arranged circumferentially at the outer periphery and extending radially and blade grooves formed between the blades. Fuel sucked through the inlet port is introduced into the blade grooves via the fuel passage to receive kinetic energy from the blades, and it is then discharged to the passage. Fuel discharged to the fuel passage is circulated through the passage, then introduced again into the blade grooves. Fuel within the passage is increased in pressure by repetition of the inflow and outflow, and discharged through the outlet port.

It is important for enhancement of both of the efficiency of the electric motor and that of the pump portion to improve the efficiency of the fuel pump. Specifically, the impeller is driven by the electric motor which rotates in fuel, producing a torque loss due to viscosity of fuel. When rotating in the housing, the impeller also produces a torque loss due to viscosity of fuel. Those torque losses are increased in proportion to the square of rpm, and thus become very great values when the fuel pump is operated at high rpm, resulting in a reduction in pump efficiency.

Then, a torque loss can be restrained by setting the specifications of the pump portion to allow achievement of a required flow rate at lower rpm. In this case, however, torque required for driving of the impeller is increased.

Moreover, because of requirements of downsizing of the fuel pump, the electric motor has been reduced in size. As described above, generation of high torque at low rpm needs operation of the electric motor in the low-efficiency range. Thus, it is important for enhancement of the pump efficiency to provide not only the specifications of the pump portion to minimize a torque loss, but also the specifications of the electric motor to allow its service in the high-efficiency range.

In connection with the art to improve the efficiency of the turbine fuel pump, various improvements in the impeller have been proposed. One of the improvements is disclosed in JP-A 8-100780 wherein each blade of the impeller has a root portion curved backward as viewed in the direction of rotation of the impeller, and a head portion extending radially outward from a curved portion to incline backward linearly. This shape of the blade allows smooth fuel flow from a blade groove to a passage even in the range of relatively low rpm, preventing a reduction in flow rate with respect to rpm, resulting in enhancement in the low-voltage characteristics and flow-rate controllability.

With the turbine fuel pump disclosed in JP-A 8-100780, as described above, each blade of the impeller has a root portion curved backward as viewed in the direction of rotation of the impeller, and a head portion extending radially outward from a curved portion to incline backward linearly. With this, the impeller allows prevention of the flow rate with respect to rpm in the range of relatively low rpm. However, since the impeller has a head portion inclining backward linearly, outflow of fuel from the blade groove is carried out in the rear direction, providing no higher kinetic energy to fuel. Thus, achievement of relatively great flow rate requires a considerable increase in rpm. This leads to an increase in torque loss in the range of relatively great flow rate, raising a problem of a reduction in pump efficiency.

SUMMARY OF THE INVENTION

It is, therefore, an object of the present invention to provide a turbine fuel pump which allows an enhancement in pump efficiency in the entire operating range.

The present invention provides generally a turbine fuel pump, which comprises: a casing for accommodating an electric motor; a housing provided to the casing, the housing comprising an annular passage between inlet and outlet ports; and an impeller rotatably arranged in the housing, the impeller comprising blades arranged on an outer periphery to extend in a radial direction of the impeller and feeding fuel through the passage while the blades are rotated by the electric motor, each blade comprising a linear portion extending linearly in the radial direction of the impeller and a curved portion extending circularly curvedly from a head of the linear portion to a forward side of the impeller as viewed in a direction of rotation of the impeller, the linear portion having a predetermined length, the predetermined length being ($\frac{1}{3}$ to $\frac{2}{3}$)×H, where H is an overall length of the impeller.

An aspect of the present invention is to provide a turbine fuel pump, which comprises: a casing for accommodating an electric motor; a housing provided to the casing, the housing comprising an annular passage between inlet and outlet ports; and an impeller rotatably arranged in the housing, the impeller comprising blades arranged on an outer periphery to extend in a radial direction of the impeller and feeding fuel through the passage while the blades are rotated by the electric motor, each blade including a plate body of substantially rectangular section, the plate body comprising a front face located on the forward side of the impeller, a rear face located on a rearward side of the impeller, and a pair of side faces located between the front face and the rear face, each blade comprising a chamfer arranged on the root side of the blade to extend in the radial direction of the impeller, the chamfer being obtained by slantly cutting a corner between the side face and the rear face of the blade, the chamfer having a predetermined length, wherein the predetermined length is ($\frac{2}{5}$ to $\frac{3}{5}$)×L, where L is a radial length of the passage.

BRIEF DESCRIPTION OF THE DRAWINGS

The other objects and features of the present invention will become apparent from the following description with reference to the accompanying drawings, wherein.

DETAILED DESCRIPTION OF THE INVENTION

Figure 1:
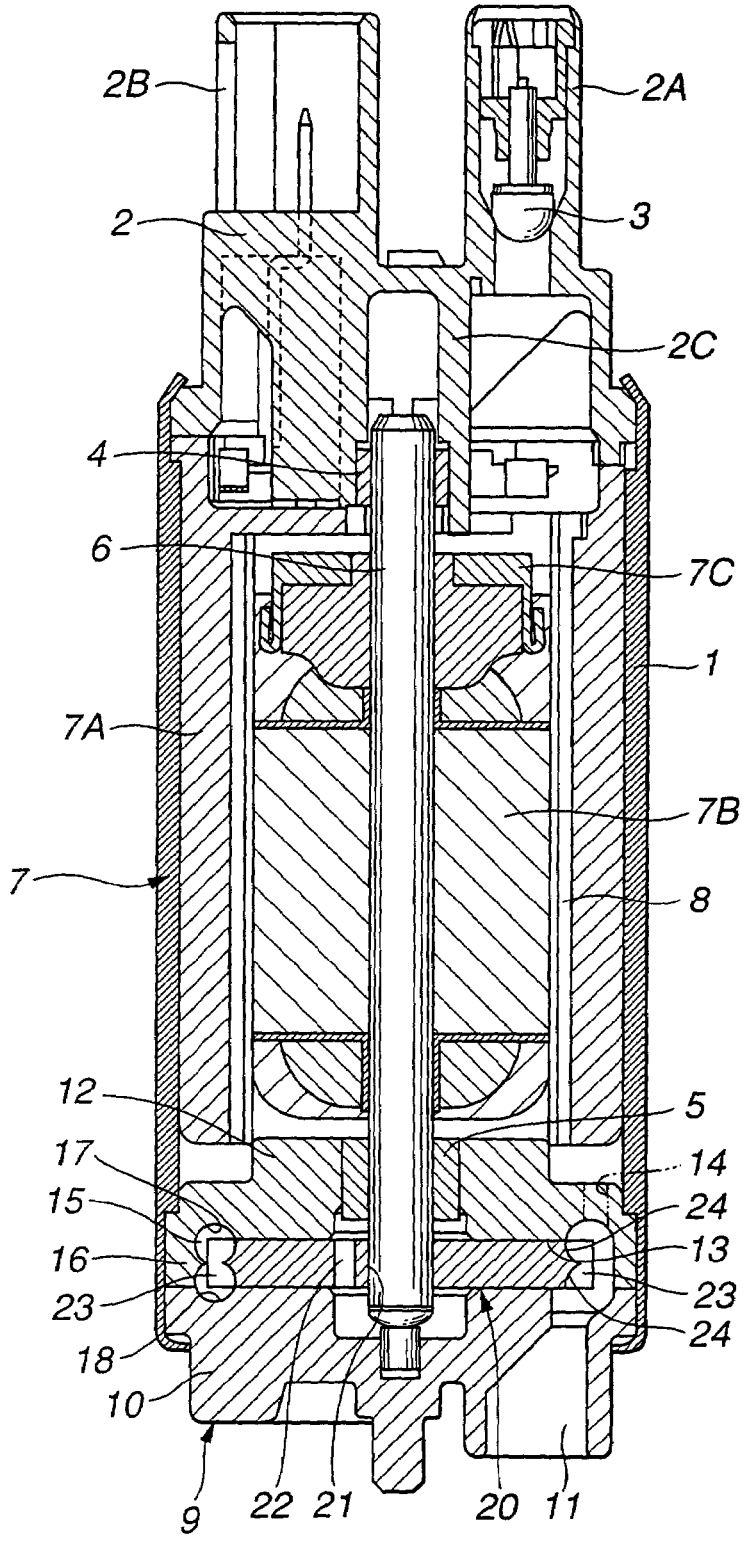
FIG. 1 is a longitudinal sectional view showing a first embodiment of a turbine fuel pump according to the present invention.

Referring to the drawings, a turbine fuel pump embodying the present invention is described.

Referring to FIGS. 1-7, there is shown first embodiment of the present invention. Referring to FIG. 1, the turbine fuel pump comprises a cylindrical casing 1 which constitutes an outer shell of the pump and has axial ends closed by a delivery cover 2 and a pump housing 9.

The delivery cover 2 of a covered cylinder is arranged at one end of the casing 1. As shown in FIG. 1, the delivery cover 2 is provided with a delivery pipe 2A and a connector 2B which protrude upward and a bearing sleeve 2C arranged in the center to extend downward.

A check valve 3 is arranged in the delivery pipe 2A to hold the residual pressure. During rotation of an electric motor 7, the check valve 3 is opened by fuel flowing into the casing 1 to allow fuel to be delivered from the delivery pipe 2A to an outside fuel line (not shown). During halts of the electric motor 7, the check valve 3 is closed to prevent fuel within the fuel line from returning to the casing 1, thus holding the fuel line at a predetermined residual pressure.

Figure 2:
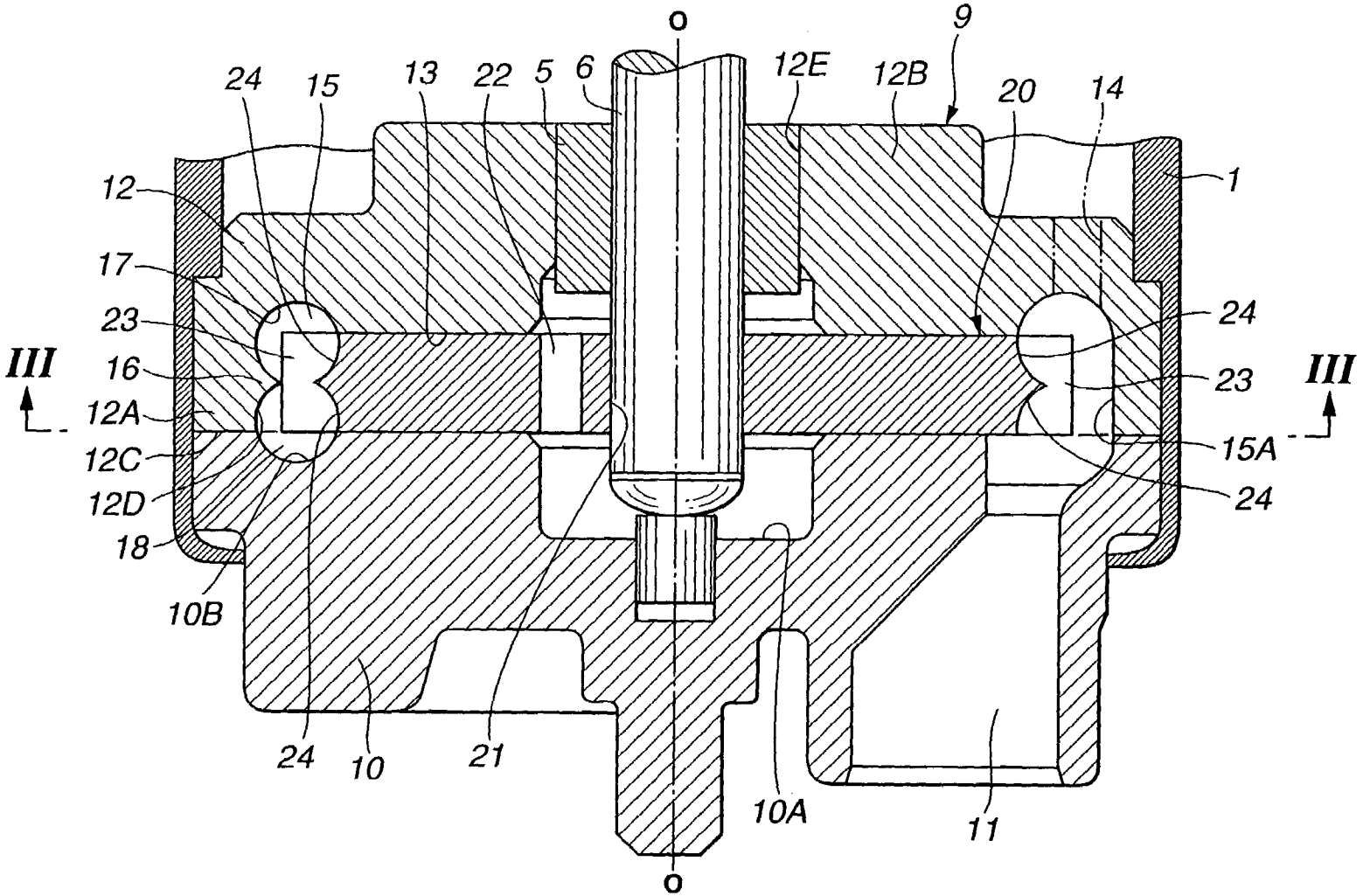
FIG. 2 is an enlarged fragmentary view of FIG. 1.

Referring also to FIG. 2, a bush 4 is engaged in the bearing sleeve 2C of the delivery cover 2, whereas a bush 5 is engaged in a stepped hole 12E of an inner housing 12. The bushes 4, 5 constitute a bearing for rotatably supporting a rotation shaft 6.

Figure 3:
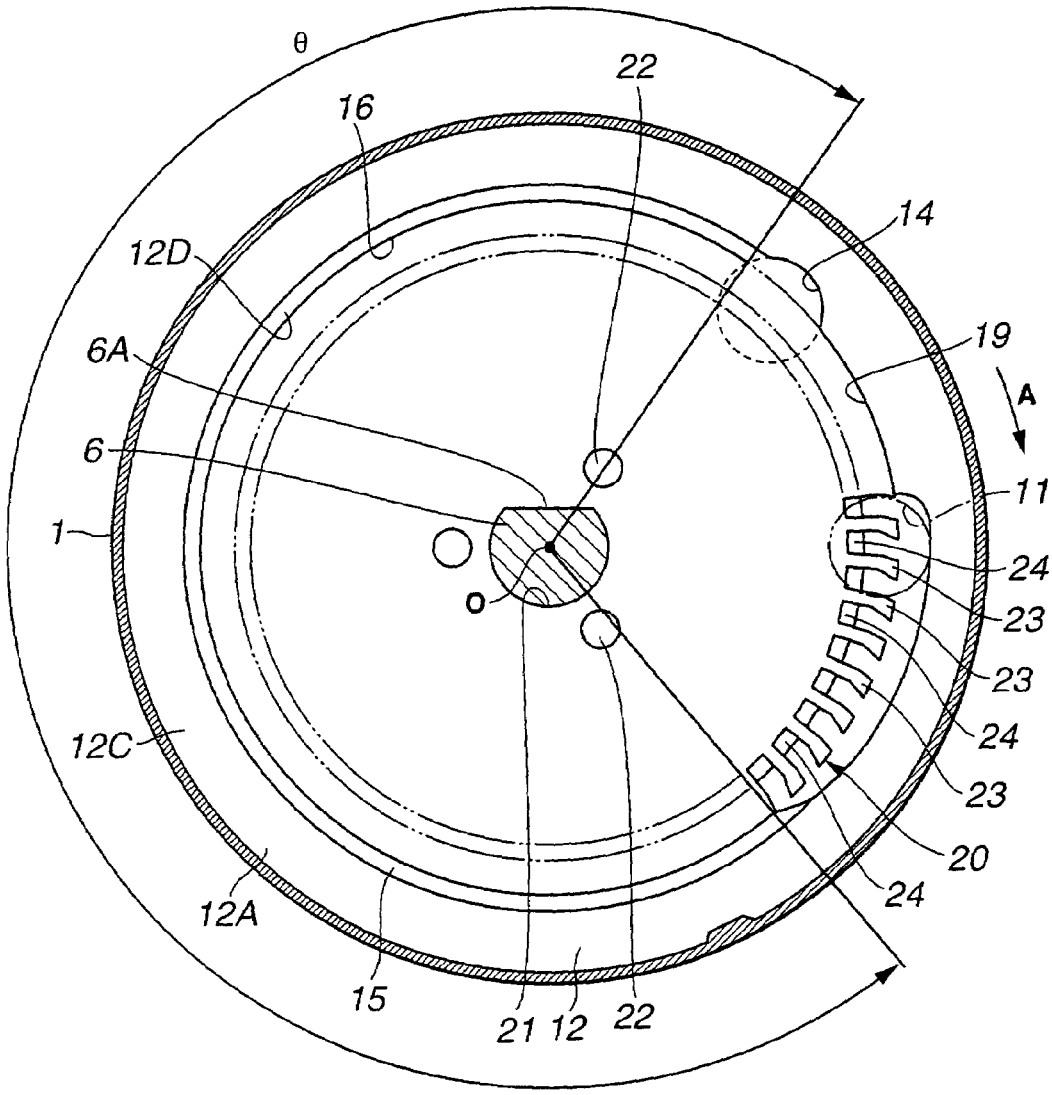
FIG. 3 is a sectional view taken along the line III-III in FIG. 2.

The rotation shaft 6 is supported between the delivery cover 2 and the pump housing 9 through the bushes 4, 5. As shown in FIG. 2, the rotation shaft 6 extends axially in the casing 1 along an axis O-O to rotatably support a rotor 7B, etc. of the electric motor 7. Referring to FIG. 3, a chamfer 6A is formed at a lower end of the rotation shaft 6 to engage with an impeller 22 in the rotation-stop state.

The electric motor 7 is accommodated in the casing 1, and comprises a cylindrical yoke 7A engaged in the casing 1 between the delivery cover 2 and the pump housing 9 and for supporting a stator (not shown) comprising a permanent magnet, a rotor 7B and a commutator 7C arranged inside the yoke 7A with a clearance and mounted to the rotation shaft 6 for unitary rotation, and a pair of brushes (not shown) making slide contact with the commutator 7C.

With the electric motor 7, when energizing the rotor 7B through the connector 2B of the delivery cover 2, the brushes, and the commutator 7C, the rotor 7B is rotated together with the rotation shaft 6 to drive the impeller 20 in the range of medium to high rpm, e.g. 5,000-8,000 rpm.

A fuel passage 8 is formed between the yoke 7A and the rotor 7B of the electric motor 7, and serves to circulate to the delivery cover 2 through a clearance between the yoke 7A and the rotor 7B fuel discharged from an outlet port 14 of the pump housing 9 to the casing 1.

The pump housing 9 is arranged at another or lower end of the casing 1, and is obtained by vertically abutting an outer housing 10 and the inner housing 12. The pump housing 9 serves to rotatably accommodate the impeller 20.

As shown in FIGS. 1 and 2, the outer housing 10 of the pump housing 9 is engagedly mounted at the lower end of the casing 1 through fixing means such as calking to close the casing 1 from the outside. The outer housing 10 is integrally formed with a fuel inlet port 11.

The outer housing 10 has a circular concave 10A formed in the shaft center (axis O-O), and a circular groove 10B of substantially semicircular section formed corresponding to the outer periphery of the impeller 20 to extend circumferentially with the axis O-O as center. As shown in FIG. 3, the circular groove 10B extends circumferentially over the range of an angle θ, and cooperates with a peripheral-wall groove 12D of the inner housing 12 to form a lower abutting-side passage 18.

The inner housing 12 serves as a housing member for constituting, together with the outer housing 10, the pump housing 9. The inner housing 12 is engaged in the casing 1 in the state abutting on the outer housing 10.

As shown in FIG. 2, the inner housing 12 is shaped like a covered flat cylinder, and comprises a cylinder portion 12A for forming a cylindrical peripheral wall and a cover portion 12B for covering the cylinder portion 12A from above. The cylindrical portion 12A is formed at the inner periphery with a circular turbine accommodating recess 13 to open on the side of an abutting face 12C of the cylindrical portion 12A with the outer housing 10. Moreover, the cylindrical portion 12A is formed with circular peripheral-wall groove 12D located below an annular protrusion 16. The circular peripheral-wall groove 12D cooperates with the circular groove 10B of the outer housing 10 to form the abutting-side passage 18. The cover portion 12B is formed with stepped hole 12E into which the bush 5 is inserted, and at the outer periphery with the outlet port 14 to extend vertically.

An annular fuel passage 15 is formed through the pump housing 9 at the outer periphery of the turbine accommodating recess 13 to extend circumferentially in a roughly C-shaped manner with the axis O as center as shown in FIG. 3. The fuel passage 15 comprises two portions divided vertically by the annular protrusion 16, i.e. an interior passage 17 and the abutting-side passage 18.

The fuel passage 15 has a beginning communicating with the inlet port 11, and a termination communicating with the outlet port 14. Moreover, the fuel passage 15 includes on the beginning side an inlet passage portion 15A for smoothly introducing into the fuel passage 15 fuel sucked through the inlet port 11.

The annular protrusion 16 is provided to the cylindrical portion 12A of the inner housing 12. As shown in FIG. 2, the annular protrusion 16 protrudes from the cylindrical portion 12A to the outer periphery of the impeller 20 radially inward in a mountain-shaped manner as viewed in section so as to divide the fuel passage 15 into upper and lower portions in the axial direction of the impeller 20, i.e. the interior passage 17 and the abutting-side passage 18.

The interior passage 17 is formed as a slot of C-shaped section arranged at an interior corner between the cylindrical portion 12A and the cover portion 12B of the inner housing 12. The abutting-side passage 18 is formed as a slot of C-shaped section by the circular groove 10B of the outer housing 10 and the peripheral-wall groove 12D of the inner housing 12.

The annular protrusion 16 extends, together with the passages 17, 18, in the circumferential direction of the impeller 20 over the range of the angle θ (=250-270°, for example) as shown in FIG. 3, thus restraining occurrence of stagnation, etc. of fuel flowing through the fuel passage 15.

A sealing partition 19 is provided to the inner housing 12 on the side of the cylinder portion 12A. As shown in FIG. 3, the sealing partition 19 is formed as a circular protrusion protruding from the cylindrical portion 12A of the inner housing 12 to a point adjacent to the outer periphery of the impeller 20. The sealing partition 19 seals the outer periphery of the impeller 20 between the inlet port 11 and the outlet port 14, allowing fuel sucked through the inlet port 11 to surely flow along the fuel passage 15.

The impeller 20 is shaped roughly like a disk out of a reinforced plastic material, for example, and is rotatably arranged in the turbine accommodating recess 13 of the pump housing 9. The impeller 20 is rotated by the electric motor 7 in the direction of arrow A in FIG. 3 to feed fuel sucked through the inlet port 11 to the outlet port 14 through the fuel passage 15.

Figure 4:
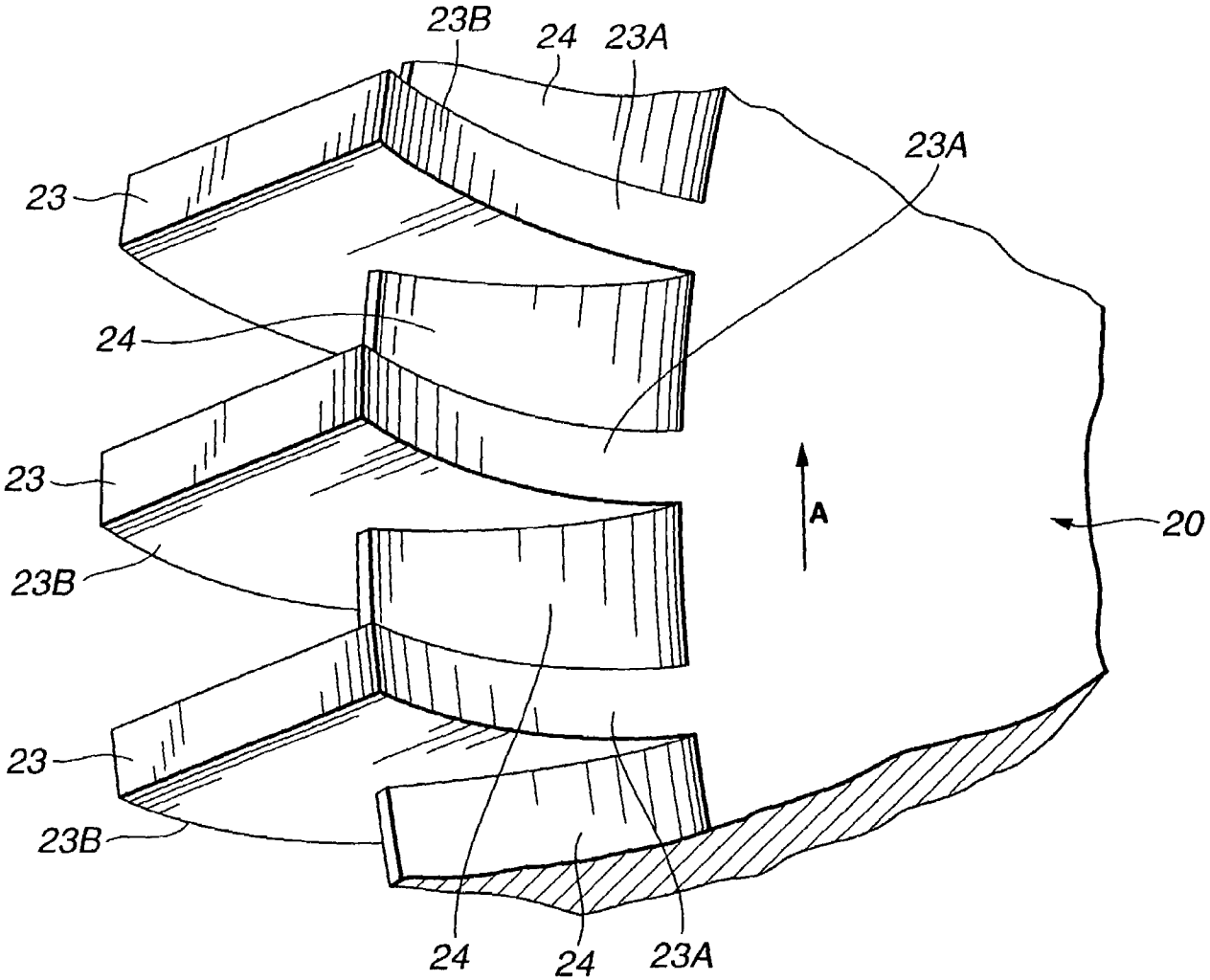
FIG. 4 is an enlarged perspective view showing blades of an impeller.

The impeller 20 has in the center of rotation (axis O-O) an engagement hole 21 in which the rotation shaft 6 is engaged. A plurality of (e.g. three) through holes 22 is arranged around the engagement hole 21. Referring to FIG. 4, the impeller 20 comprises at the outer periphery a plurality of blades 23 arranged circumferentially to extend radially. A pair of circular recesses 24 is arranged between the adjacent blades 23, each recess 24 having a curvature corresponding roughly to a circular shape of the passages 17, 18 of the pump housing 9.

The impeller 20 is driven, together with the rotation shaft 6, by the electric motor 11 with the upper and lower faces being floating-sealed between the upper face of the outer housing 10 and the lower face of the cover portion 12B in the turbine accommodating recess 13. Each through hole 22 of the impeller 20 has a function of uniformizing the fuel pressure, etc. between the circular concave 10A of the outer housing 10 and the stepped hole 12E of the inner housing 12.

Figure 5:
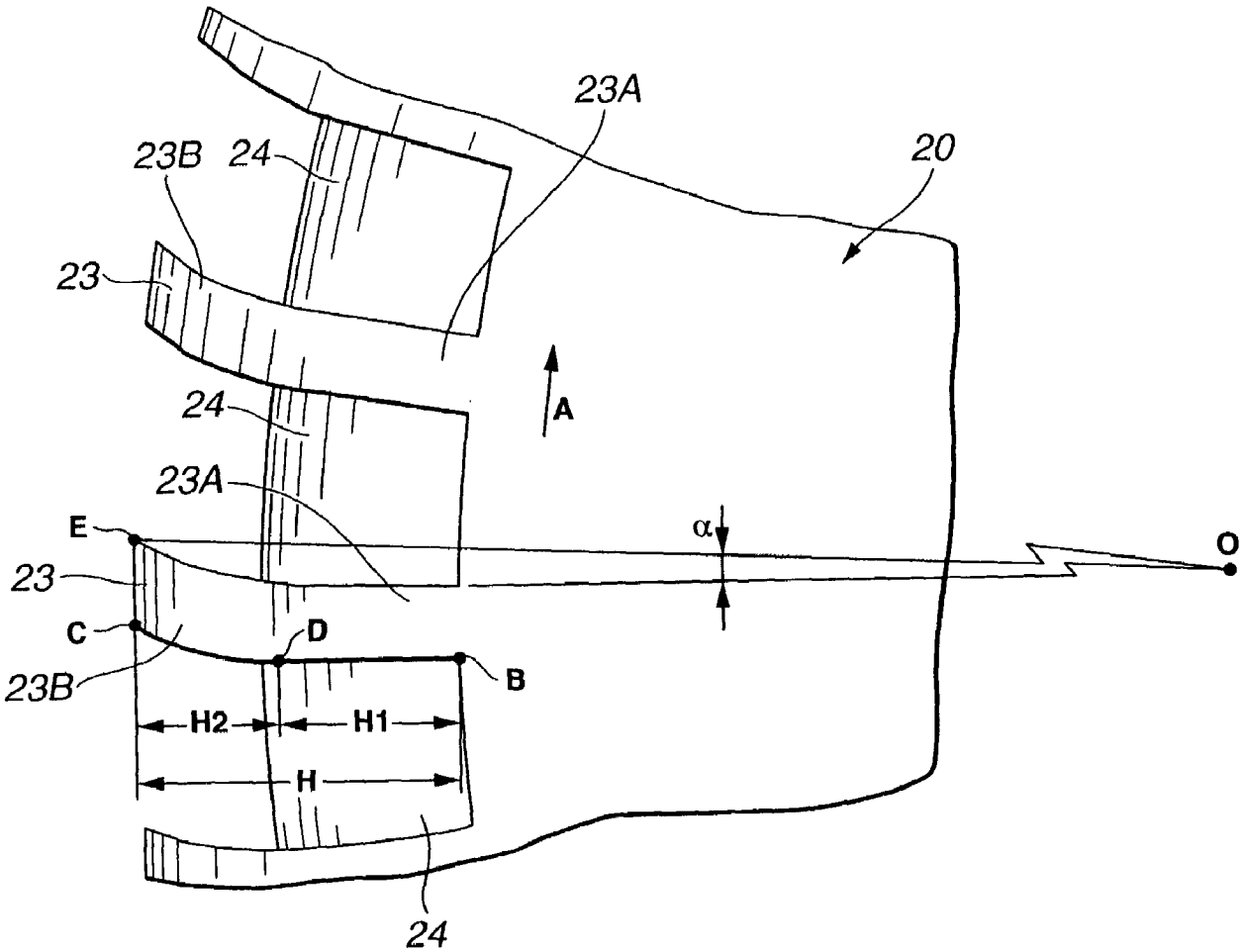
FIG. 5 is a plan view showing the blades of the impeller.

Referring to FIG. 5, each blade 23 comprises a linear blade portion 23A located on the root side and extending linearly in the radial direction of the impeller 20, and a curved blade portion 23B extending circularly curvedly from the head of the linear blade portion 23A to the forward side of the impeller 20 as viewed in the direction of rotation thereof, i.e. in the direction of arrow A.

Next, the shape of the blade 23 is described in detail. As shown in FIG. 5, the length from a root position B of the linear blade portion 23A to a head position C of the curved blade portion 23B, i.e. overall length of the blade 23, is referred to as overall length H; the length from the root position B of the linear blade portion 23A to a staring-point position D at which the curved blade portion 23B starts, i.e. head position D of the linear blade portion 23A, is referred to as linear-portion length H1; and the length from the starting-point position D of the curved blade portion 23B to the head position C thereof is referred to as curved-portion length H2.

The forward-tilt length of the curved blade portion 23B between a most forward position E inclined forward in the direction of rotation and the linear blade portion 23A is represented by an angle a with reference to the center of rotation (axis O-O) of the impeller 20.

In the first embodiment, it is revealed that when the linear-portion length H1 of the linear blade portion 23A with respect to the overall length H of the blade 23, i.e. the starting-point position D of the curved blade portion 23B, is set in accordance with the following formula (1), excellent pump efficiency can be obtained:

$$\frac{1}{3} \leqq (H1/H) \leqq \frac{2}{3} \quad (1)$$

In this connection, it is revealed that when H1/H in the formula (1) is set within the range given by the following formula (2), more excellent pump efficiency can be obtained:

$$\frac{2}{5} \leqq (H1/H) \leqq \frac{3}{5} \quad (2)$$

Moreover, it is revealed that when the angle a corresponding to the forward-tilt length of the curved blade portion 23B is set in accordance with the following formula (3), excellent pump efficiency can be obtained:

$$0.5 \leqq \alpha \leqq 2.0 \quad (3)$$

In this connection, it is revealed that when α in the formula (3) is set within the range given by the following formula (4), more excellent pump efficiency can be obtained:

$$1.0 \leqq \alpha \leqq 1.5 \quad (4)$$

Next, operation of the first embodiment is described. When energizing the pump from the outside through the connector 2B of the delivery cover 2, a drive current is supplied to the rotor 7B of the electric motor 7 to rotate the rotor 7B and the rotation shaft 6 together, driving the impeller 20 in the pump housing 9. By rotation of the impeller 20, fuel in a fuel tank (not shown) is sucked into the fuel passage 15 through the inlet port 11, which is then fed along the fuel passage 15 by the blades 23 of the impeller 20, and discharged into the casing 1 through the outlet port 14.

Fuel discharged into the casing 1 is circulated in the casing 1 to the delivery cover 2 through the fuel passage 8, etc. so as to open the check valve 3 in the delivery pipe 2A. Then, fuel is supplied from the delivery pipe 2A to an injection valve (not shown) of the engine main body through an outside fuel line (not shown) at the delivery pressure of 200-500 kPa and the delivery rate of 30-200 L/h, for example.

Figure 6:
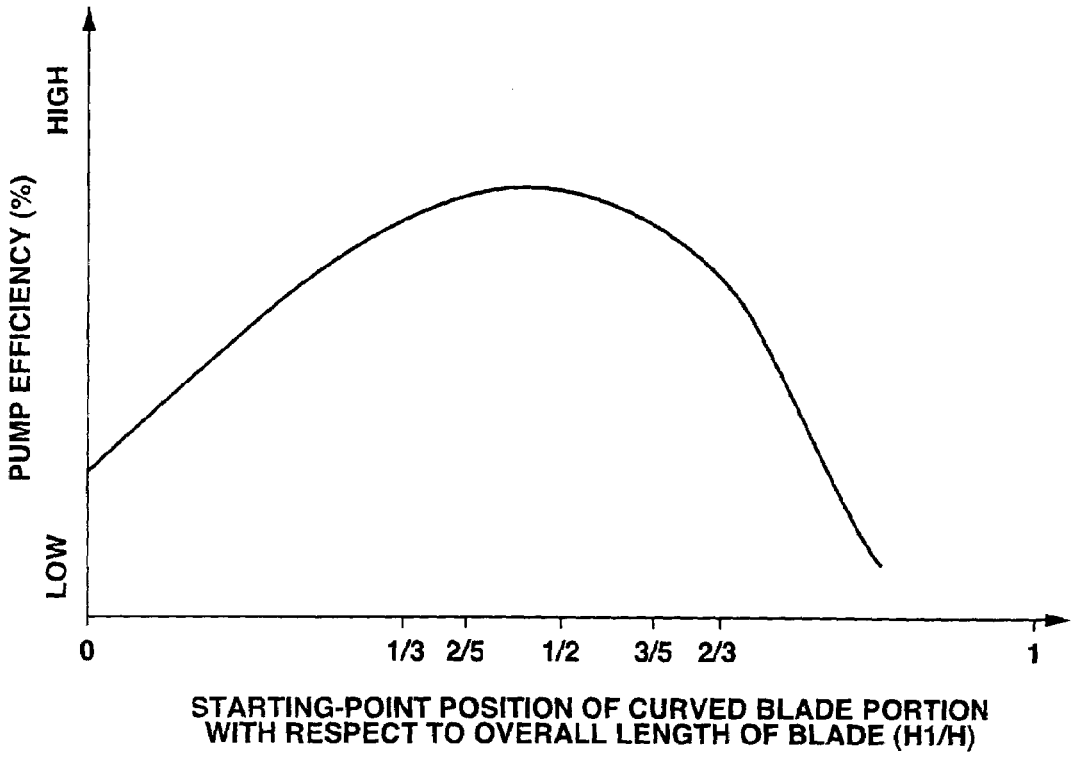
FIG. 6 is a graph illustrating the relationship between the starting-point position of a curved blade portion and the pump efficiency.

As a consequence of our study on the ratio of the linear-portion length H1 of the linear blade portion 23A to the overall length H of the blade 23, it is confirmed that when the ratio H1/H is set within the range of ⅓-⅔ as shown in the formula (1), preferably, within the range of ⅖-⅗ as shown in the formula (3), higher pump efficiency can be obtained as shown by a characteristic curve in FIG. 6. In this case, the angle a corresponding to the forward-tilt length of the curved blade portion 23B is set at about 1.2°.

Figure 7:
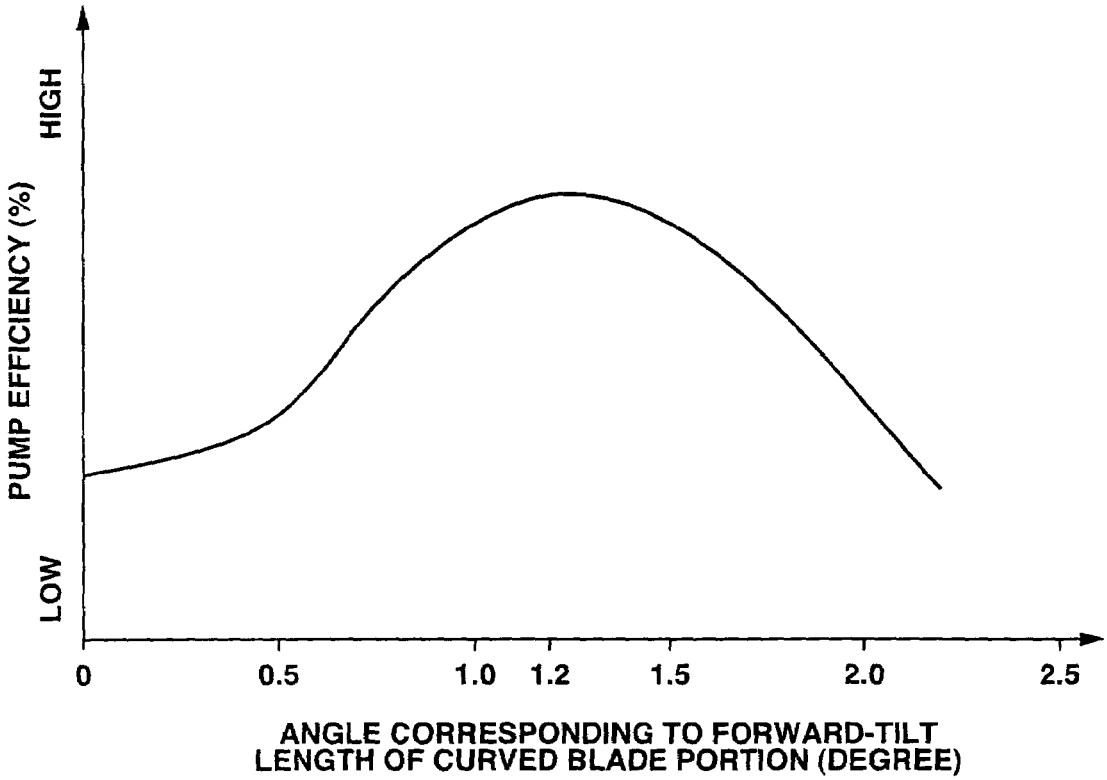
FIG. 7 is a graph similar to FIG. 6, illustrating the relationship between the angle corresponding to the forward-tilt length of the curved blade portion and the pump efficiency.

Moreover, as a consequence of our study on the angle αcorresponding to the forward-tilt length of the curved blade portion 23B, it is confirmed that when the angle a is set within the range of 0.5-2.0° as shown in the formula (3), preferably, within the range of 1.0-1.5° as shown in the formula (4), higher pump efficiency can be obtained as shown by a characteristic curve in FIG. 7. In this case, the ratio of the linear-portion length H1 of the linear blade portion 23A to the overall length H of the blade 23 is set at about ½.

In such a manner, it is revealed that when the ratio of the linear-portion length H1 of the linear blade portion 23A to the overall length H of the blade 23 is set at about ½ which is within the range of ⅖-⅗, and the angle a corresponding to the forward-tilt length of the curved blade portion 23B is set at about 1.2° which is within the range of 1.0-1.5°, the highest pump efficiency can be obtained.

In the first embodiment, therefore, the starting-point position D at which the curved blade portion 23B of the blade 23 of the impeller 20 starts to curve, i.e. the linear-portion length H1, is set at a position of ⅖-⅗(about ½) with respect to the overall length H of the blade 23, whereas the angle a corresponding to the forward-tilt length of the curved blade portion 23B is set at 1.0-1.5° (about 1.2°).

This allows the blade 23 to have the curved blade portion 23B curving mildly from the middle in the length direction with an appropriate forward-tilt length secured in the direction of rotation of the impeller 20.

As a result, when rotating the impeller 20, smooth fuel flow can be obtained from the blade grooves between the blades 23 to the fuel passage 15 even in the range of relatively low flow rate, preventing a reduction in flow rate with respect to rpm. Moreover, the impeller 20 provides an appropriate kinetic energy to fuel, allowing restraint of an increase in torque loss in the range of relatively great flow rate and operation of the pump in the higher efficiency range of the electric motor 7, resulting in achievement of higher pump efficiency in the entire operating range of the pump.

Moreover, since the curved blade portion 23B of the blade 23 is formed to curve circularly, fuel can smoothly flow along the circular surface of the curved blade portion 23B, resulting in smoother outflow of fuel from the blade grooves between the blades 23.

Referring to FIGS. 8-14, there is shown second embodiment of the present invention which is substantially the same in structure as the first embodiment except that a chamfer 39 obtained by slantly cutting a corner between the side face and the rear face of a blade 35 is arranged on the root side of the blade 35 to extend in the radial direction of an impeller 32.

Figure 8:
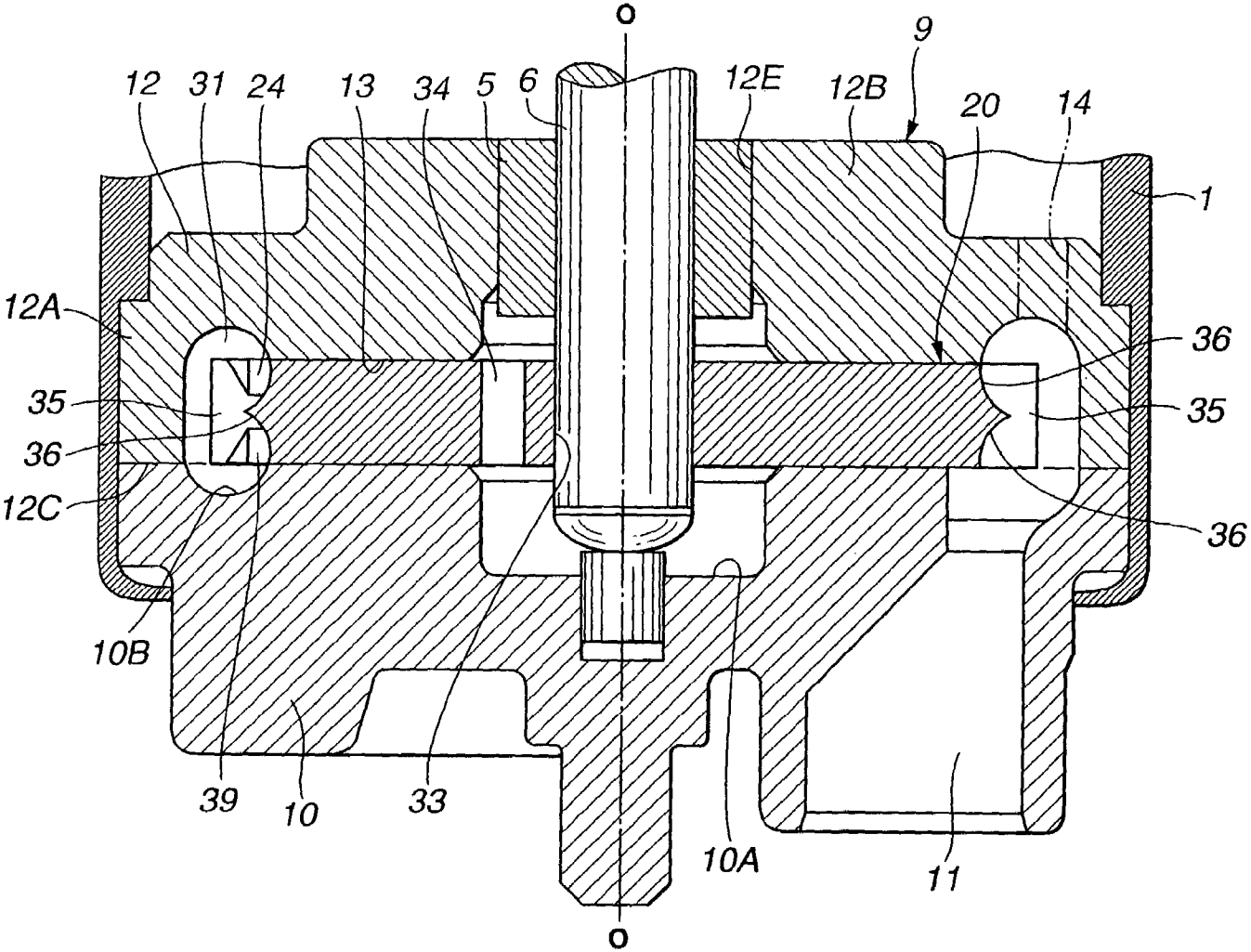
FIG. 8 is a view similar to FIG. 2, showing a second embodiment of the present invention.
Figure 9:
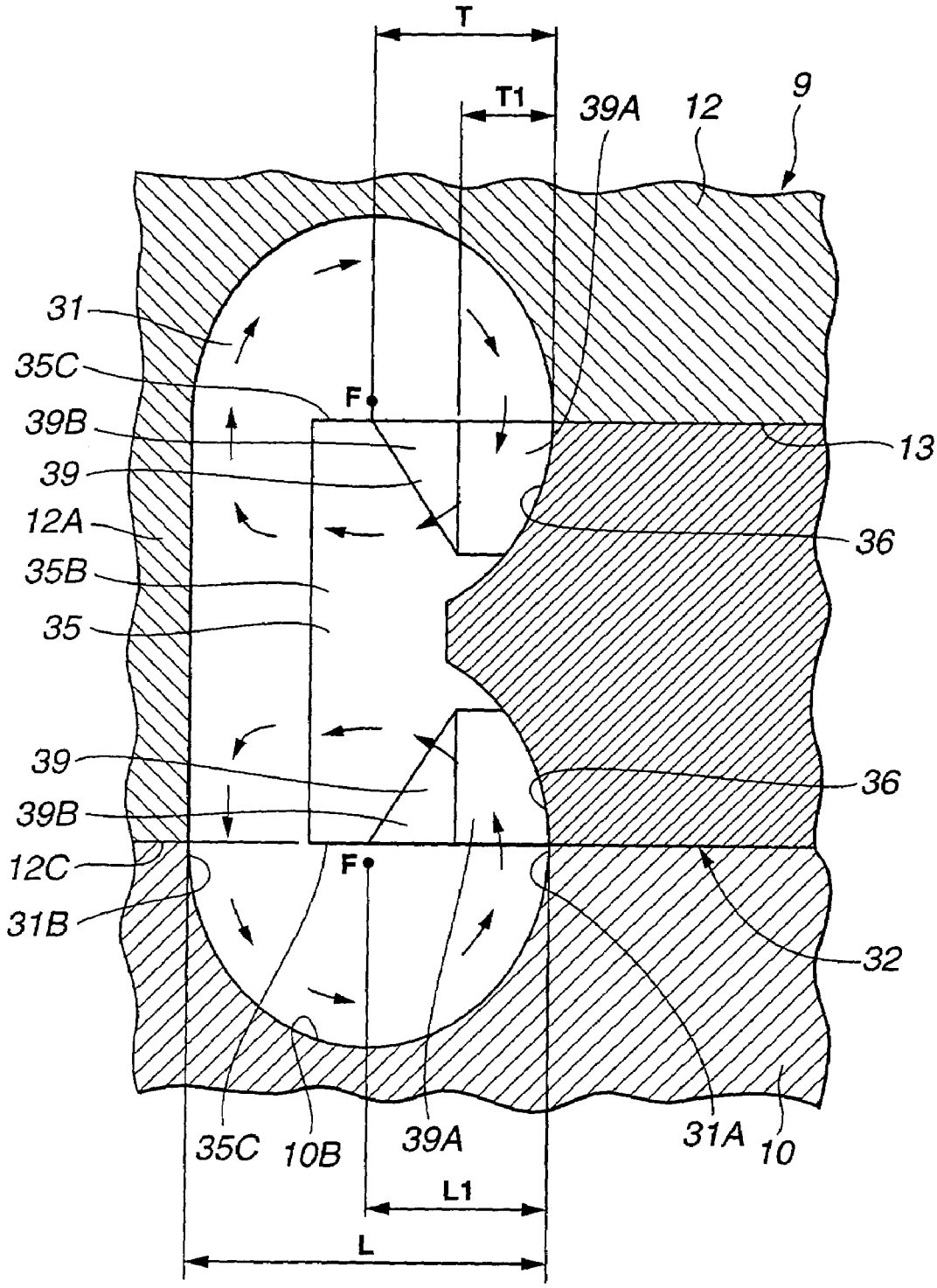
FIG. 9 is a further enlarged view of FIG. 8.

Referring to FIGS. 8 and 9, an annular fuel passage 31 is arranged in place of the fuel passage 15 in the first embodiment. The fuel passage 31 includes circular groove 10B of the outer housing 10, and is formed as a passage of larger vertical length and C-shaped section extending circumferentially with the axis O-O as center.

The fuel passage 31 has upper and lower ends formed circularly, along which fuel flows in a circulating manner as indicated by arrows in FIG. 9, so that the perimeter of the center of a circular portion of the fuel passage 31 forms a passage center F when fuel is fed through the fuel passage 31. The passage center F with respect to a radial length L from an internal end 31A of the fuel passage 31 to an external end 31B thereof is positioned at a distance L1 of about ½ from the internal end 31A. The fuel passage 31 has a beginning communicating with the inlet port 11, and a termination communicating with the outlet port 14.

The impeller 32 is shaped roughly like a disk out of a reinforced plastic material, for example, and is rotatably arranged in the turbine accommodating recess 13 of the pump housing 9.

Figure 10:
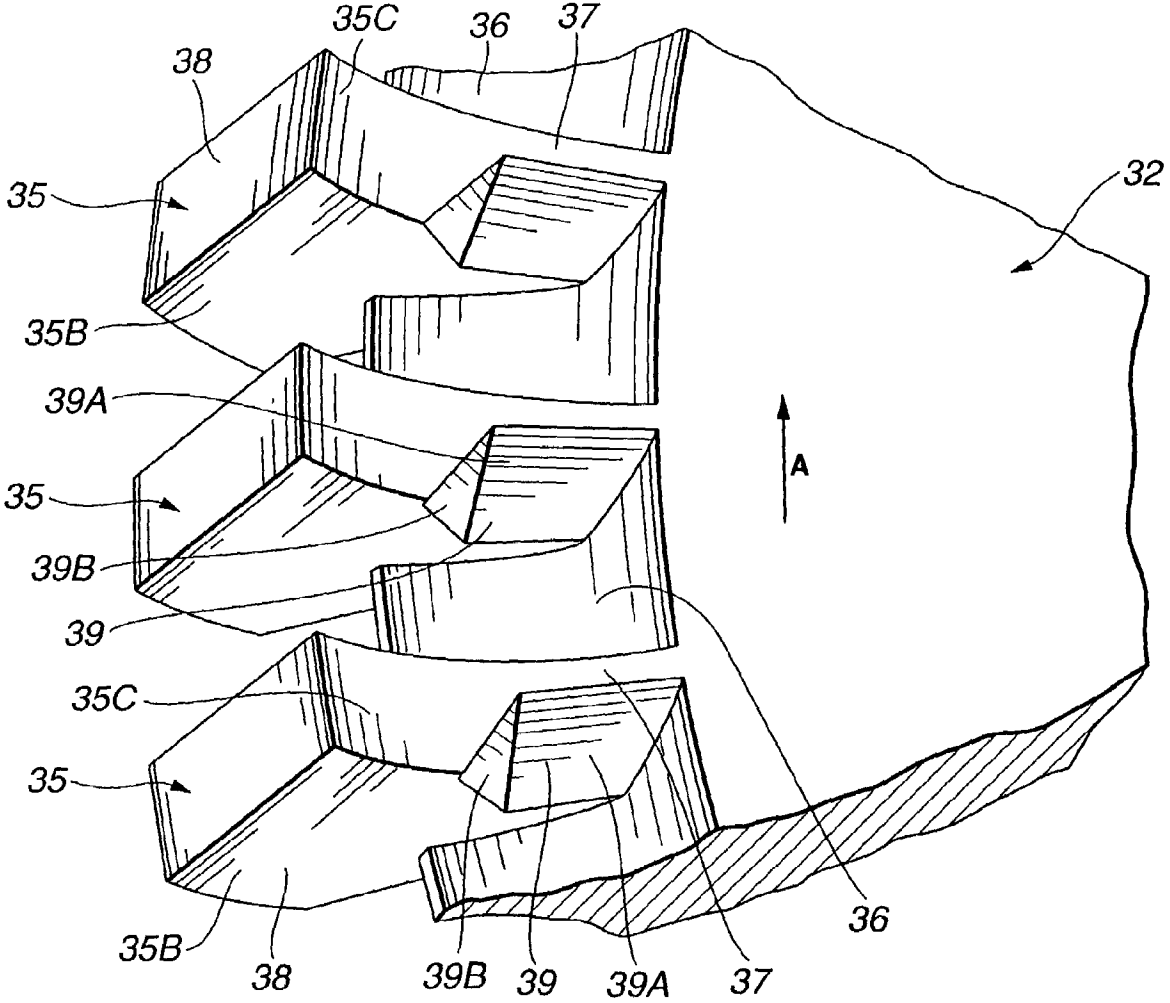
FIG. 10 is a view similar to FIG. 4, showing the blade of the impeller.

The impeller 32 has in the center of rotation (axis O-O) an engagement hole 33 in which the rotation shaft 6 is engaged. A plurality of (e.g. three) through holes 34 is arranged around the engagement hole 33. Referring to FIG. 10, the impeller 20 comprises at the outer periphery a plurality of blades 35 arranged circumferentially to extend radially. A pair of circular recesses 36 is arranged between the adjacent blades 35 in a mountain-shaped manner, each recess 36 having a curvature corresponding roughly to a circular shape of the fuel passage 31 of the pump housing 9.

Figure 11:
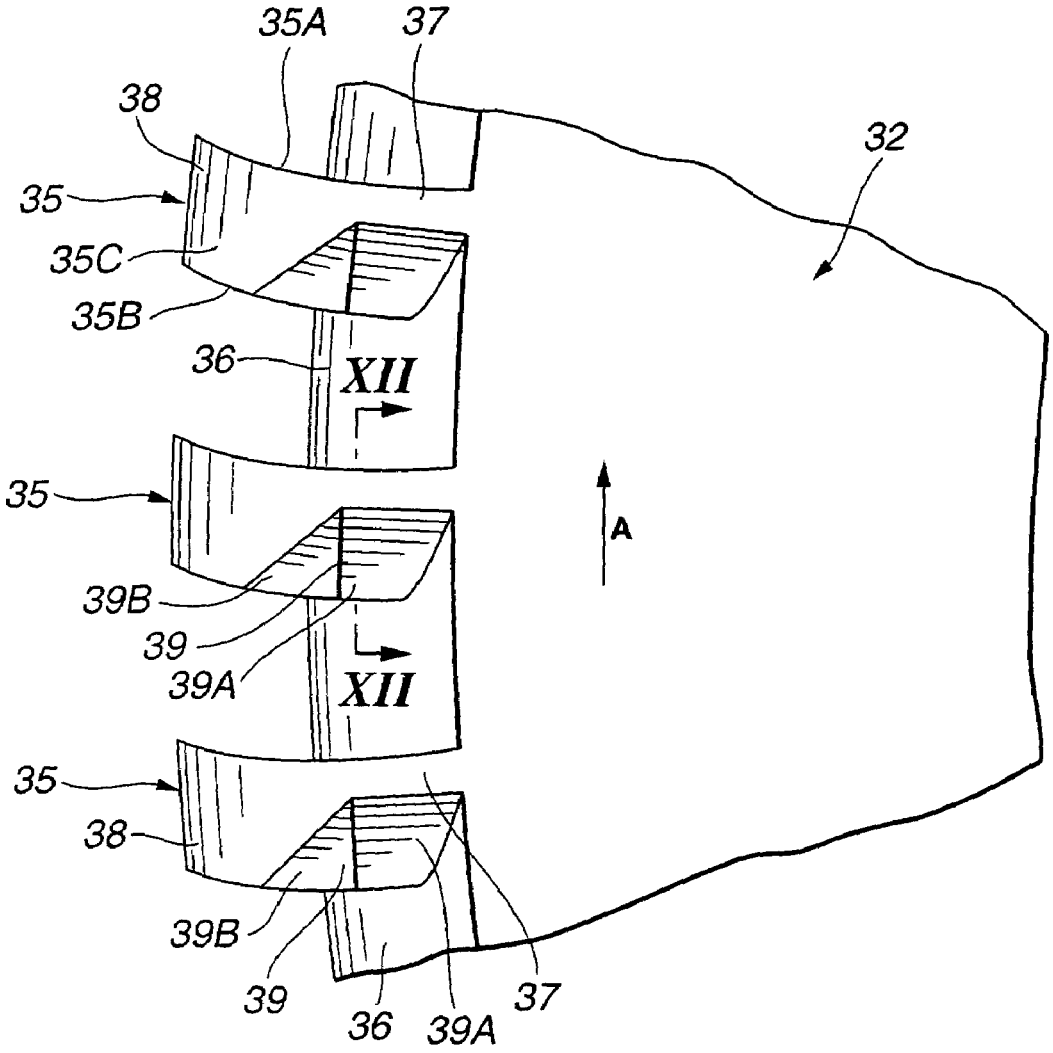
FIG. 11 is a view similar to FIG. 5, showing the blades of the impeller.

Referring to FIGS. 10 and 11, the blade 35 is formed as a plate body of substantially rectangular section comprising a front face 35A located on the forward side as viewed in the direction of rotation of the impeller 32, i.e. in the direction of arrow A, a rear face 35B located on the rearward side as viewed in the direction of rotation, and a pair of side faces 35C located between the front face 35A and the rear face 35B.

The blade 35 includes on the root side a linear blade portion 37 extending linearly in the radial direction of the impeller 32, and on the head side a curved blade portion 38 curving circularly to the forward side as viewed in the direction of rotation of the impeller 32. The shape and dimension of the blade portions 37, 38 is set in accordance with the formulas (1) and (3), preferably, the formulas (2) and (4) as described above in connection with the first embodiment.

Figure 12:
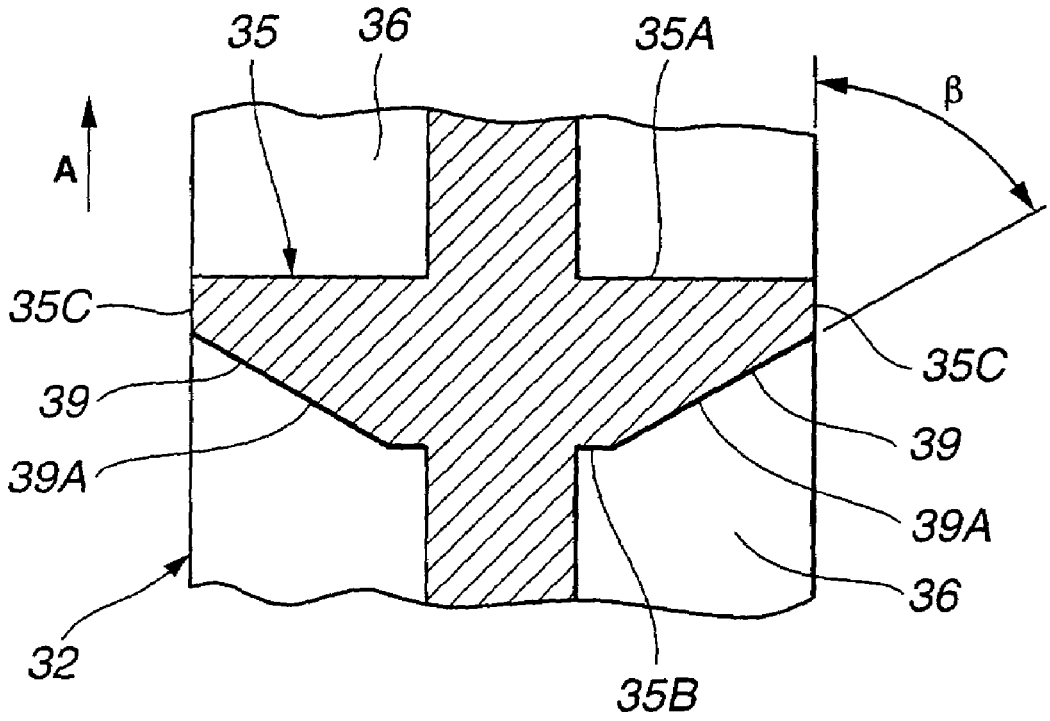
FIG. 12 is a view similar to FIG. 3, taken along the line XII-XII in FIG. 11.

A pair of chamfers 39 is arranged on the root side of the blade 35 to extend in the radial direction of the impeller 32. Referring to FIGS. 10-12, each chamfer 39 is obtained by slantly cutting a corner between the side face 35C and the rear face 35B of the blade 35. An overall length T of the chamfer 39 is set roughly equal to the distance L1 from the internal end 31A to the passage center F of the fuel passage 31, i.e. a value of (⅖-⅗)×L, where L is radial length of the fuel passage 31, in accordance with the following formula (5):

$$\frac{2}{5} \leqq (T/L) \leqq \frac{3}{5} \tag{5}$$

The overall length T of the chamfer 39 is set, preferably, at a value of (9/20-11/20)×L in accordance with the following formula (6):

$$\frac{9}{20} \leqq (T/L) \leqq \frac{11}{20} \tag{6}$$

The overall length T of the chamfer 39 within the range given by the formulas (5) and (6) is set, optimally, at a value of ½ with respect to the radial length L of the fuel passage 31. With this, the chamfer 39 is formed to extend the passage center F which forms a center when fuel flows through the fuel passage 31 in a circulating manner, allowing the most excellent achievement of an effect of smooth fuel flow into the blade grooves between the blades 35.

The chamfer 39 comprises a roughly rectangular root-side chamfer portion 39A located on the root side and having substantially constant chamfer width, and a roughly triangular head-side chamfer portion 39B having chamfer width gradually reduced from the head of the root-side chamfer portion 39A.

The root-side chamfer portion 39A is formed by cutting a corner to have substantially constant chamfer width, achieving smooth fuel flow into the blade grooves between the blades 36 from the root side thereof, allowing a reduction in resistance to fuel flow. On the other hand, the head-side chamfer portion 39B is formed with chamfer width gradually reduced to the head thereof, achieving smooth connection between the rear face 35B and side face 35C of the blade 35 and the root-side chamfer portion 39A, allowing smooth fuel flow therebetween.

Referring to FIG. 12, the shape of the root-side chamfer portion 39A of the chamfer 39 is described in detail. An angle of inclination β of the root-side chamfer portion 39A with respect to the side face 35C of the blade 35 is set within the range of 30-70° in accordance with the following formula (7):

$$30 \leqq \beta \leqq 70 \quad (7)$$

The angle of inclination β in the formula (7) is set, preferably, within the range of 40-60° in accordance with the following formula (8):

$$40 \leqq \beta \leqq 80 \quad (8)$$

Referring to FIG. 9, a length T1 of the root-side chamfer portion 39A with respect to an overall length T of the chamfer 39 is set at a value of (⅕-⅘)×T in accordance with the following formula (9):

$$1/5 \leqq (T1/T) \leqq 4/5 \quad (9)$$

The length T1 of the root-side chamfer portion 39A is set, preferably, at a value (⅖-⅗)×T in accordance with the following formula (10):

$$2/5 \leqq (T1/T) \leqq 3/5 \quad (10)$$

Figure 13:
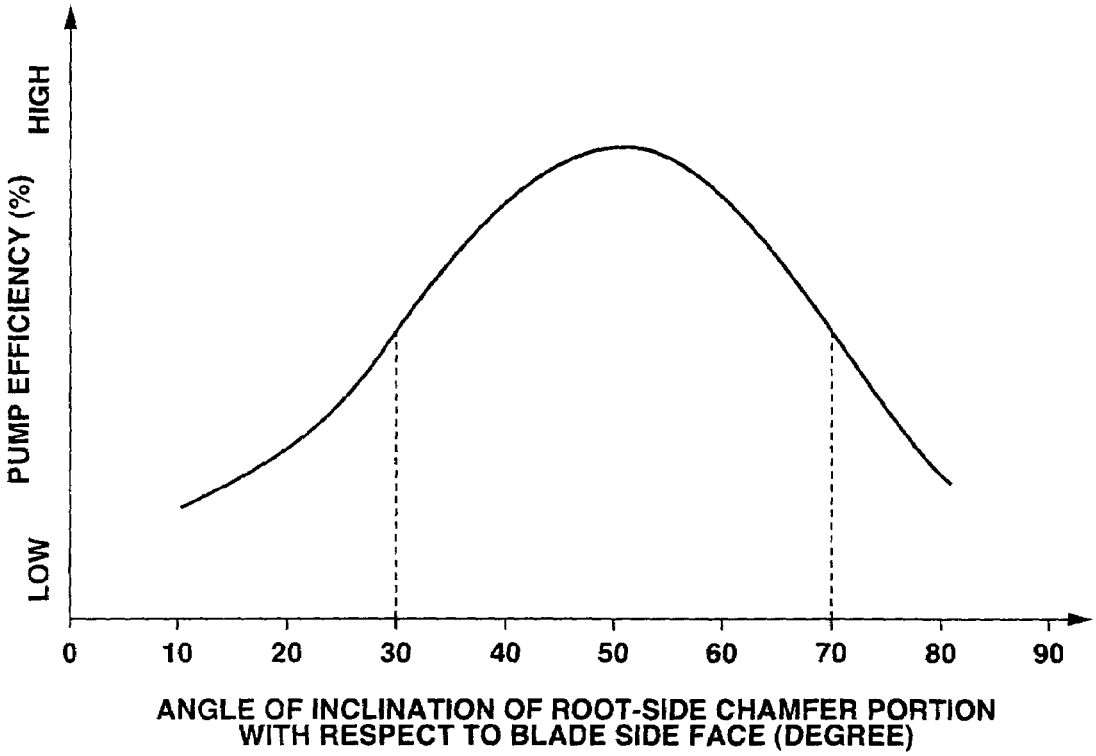
FIG. 13 is a graph similar to FIG. 7, illustrating the relationship between the angle of inclination of a root-side chamfer portion and the pump efficiency.

As a consequence of our study on the angle of inclination β of the root-side chamfer portion 39A with respect to the side face 35C of the blade 35, it is confirmed that when the angle of inclination β is set within the range of 30-70° as shown in the formula (7); preferably, within the range of 40-60° as shown in the formula (8), higher pump efficiency can be obtained as shown by a characteristic curve in FIG. 13.

In this case, the ratio of the length T1 of the root-side chamfer portion 39A to the overall length T of the chamfer 39 is set at about ½. With this, the angle of inclination β of the root-side chamfer portion 39A can be set substantially equal to the flow angle of fuel running from the side face 35C of the blade 35 to the rear face 35B thereof, resulting in smooth fuel flow along the root-side chamfer portion 39A.

Figure 14:
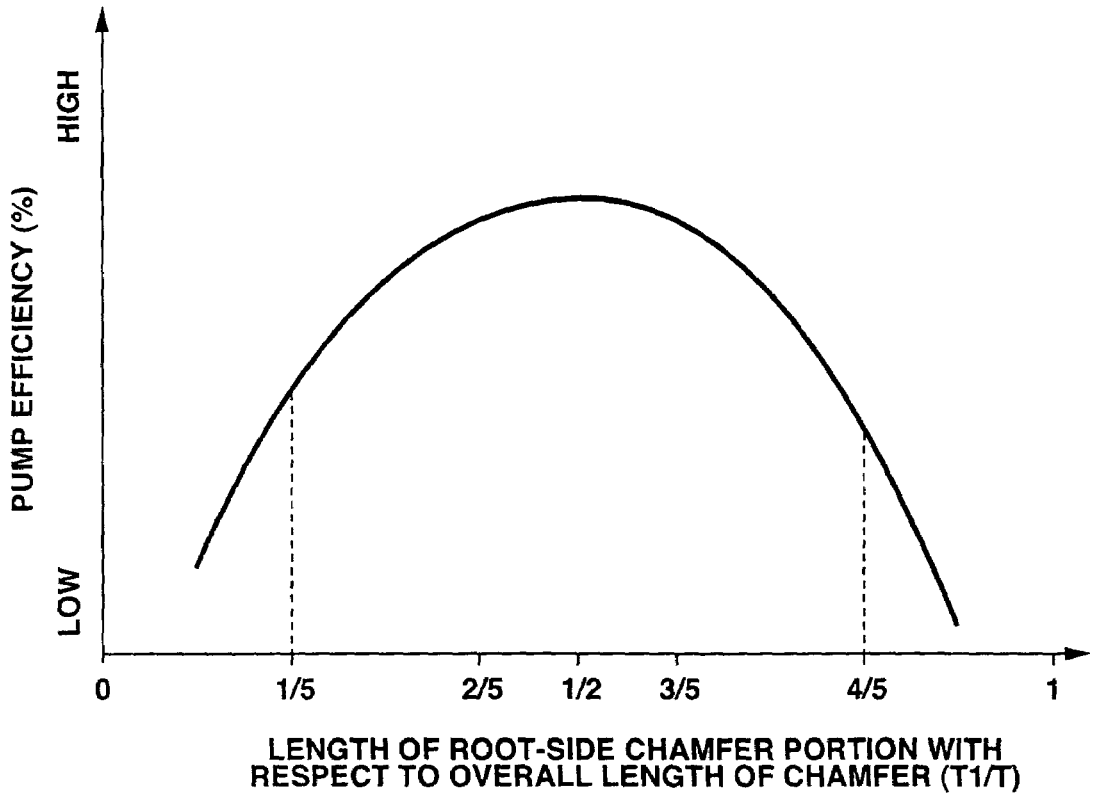
FIG. 14 is a graph similar to FIG. 13, illustrating the relationship between the length of the root-side chamfer portion and the pump efficiency.

Moreover, as a consequence of our study on the ratio of the length T1 of the root-side chamfer portion 39A to the overall length T of the chamfer 39, it is confirmed that when the ratio T1/T is set within the range of ⅕-⅘ as shown in the formula (9), preferably, within the range of ⅖-⅗ as shown in the formula (10), higher pump efficiency can be obtained as shown by a characteristic curve in FIG. 14.

In this case, the angle of inclination β of the root-side chamfer portion 39A with respect to the side face 35C of the blade 35 is set at about 50°. With this, the root-side chamfer portion 39A restrains swirls which may occur on the root side of the blade 35 through a large recess of constant width, allowing smooth fuel inflow.

Moreover, our study reveals that since the head-side chamfer portion 39B having chamfer width gradually reduced to the head ensures smooth connection between the rear face 35B and side face 35C of the blade 35 and the root-side chamfer portion 39A, fuel can flow smoothly from the side face 35C of the blade 35 to the root-side chamfer portion 39A and from the root-side chamfer portion 39A to the rear face 35B, allowing achievement of higher pump efficiency.

In such a manner, it is revealed that when the ratio T/L of the overall length T of the chamfer 39 to the radial length L of the fuel passage 31 is set at ½ which is within the range of 9/20-11/20, the angle of inclination β of the root-side chamfer portion 39A with respect to the side face 35C of the blade 35 is set at 50° which is within the range of 40-60°, and the ratio T1/T of the length T1 of the root-side chamfer portion 39A to the overall length T of the chamfer 39 is set at ½ which is within the range of ⅖-⅗, the highest pump efficiency can be obtained.

In the second embodiment, the chamfer 39 obtained by slantly cutting a corner between the side face 35C and the rear face 35B is arranged on the side of the impeller 32. Therefore, when rotating the impeller 32, the chamfer 39 allows smooth flow of fuel along the root-side chamfer portion 39A and the head-side chamfer portion 39B.

Moreover, the chamfer 39 is designed such that the ratio of the overall length T extending in the radial direction of the impeller 32 with respect to the radial length L of the fuel passage 31 is set at 9/20-11/20 (preferably, ½), and the angle of inclination β of the root-side chamfer portion 39A with respect to the side face 35C of the blade 35 is set at 40-60° (preferably, 50°), and the ratio of the length T1 of the root-side chamfer portion 39A to the overall length T of the chamfer 39 is set at ⅖-⅗ (preferably, ½).

Thus, in the second embodiment, the position and length of the chamfer 39 (root-side chamfer portion 39A) and the angle of inclination of the root-side chamfer portion 39A can be set to correspond to the inflow position of fuel flowing into the blade grooves between the blades 35 through the fuel passage 31, the size required for smooth fuel inflow, and the angle allowing smooth fuel inflow, providing smoother fuel flow from the blade grooves between the blades 35 to the fuel passage 31 as compared with the first embodiment, allowing achievement of higher pump efficiency.

Figure 15:
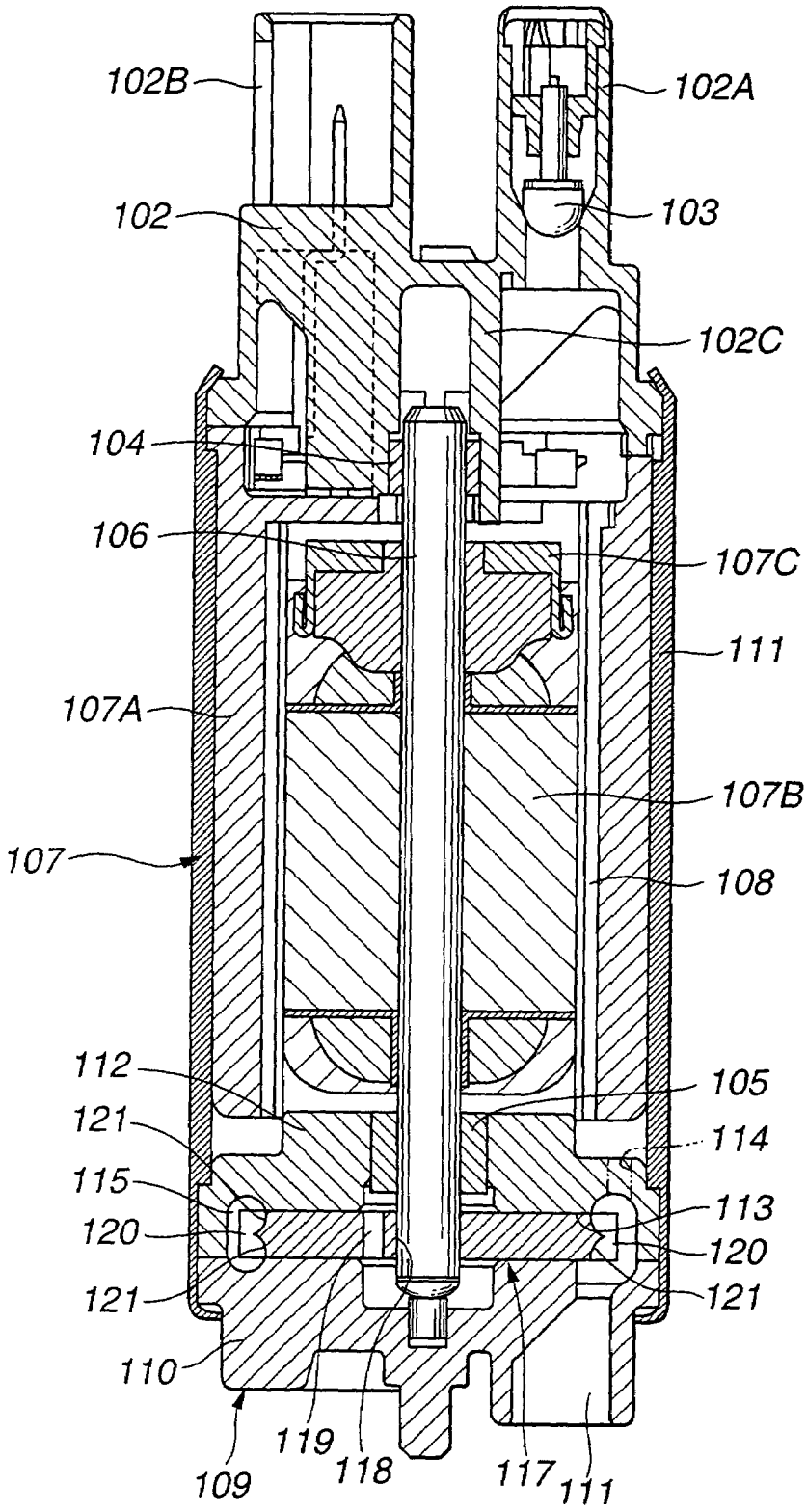
FIG. 15 is a view similar to FIG. 1, showing a third embodiment of the present invention.

Referring to FIGS. 15-23, there is shown third embodiment of the present invention. Referring to FIG. 15, the turbine fuel pump comprises a cylindrical casing 101 which constitutes an outer shell of the pump and has axial ends closed by a delivery cover 102 and a pump housing 109.

The delivery cover 102 of a covered cylinder is arranged at one end of the casing 101. As shown in FIG. 15, the delivery cover 102 is provided with a delivery pipe 102A and a connector 102B which protrude upward and a bearing sleeve 102C arranged in the center to extend downward.

A check valve 103 is arranged in the delivery pipe 102A to hold the residual pressure. During rotation of an electric motor 107, the check valve 103 is opened by fuel flowing into the casing 101 to allow fuel to be delivered from the delivery pipe 102A to an outside fuel line (not shown). During halts of the electric motor 107, the check valve 103 is closed to prevent fuel within the fuel line from returning to the casing 101, thus holding the fuel line at a predetermined residual pressure.

Figure 16:
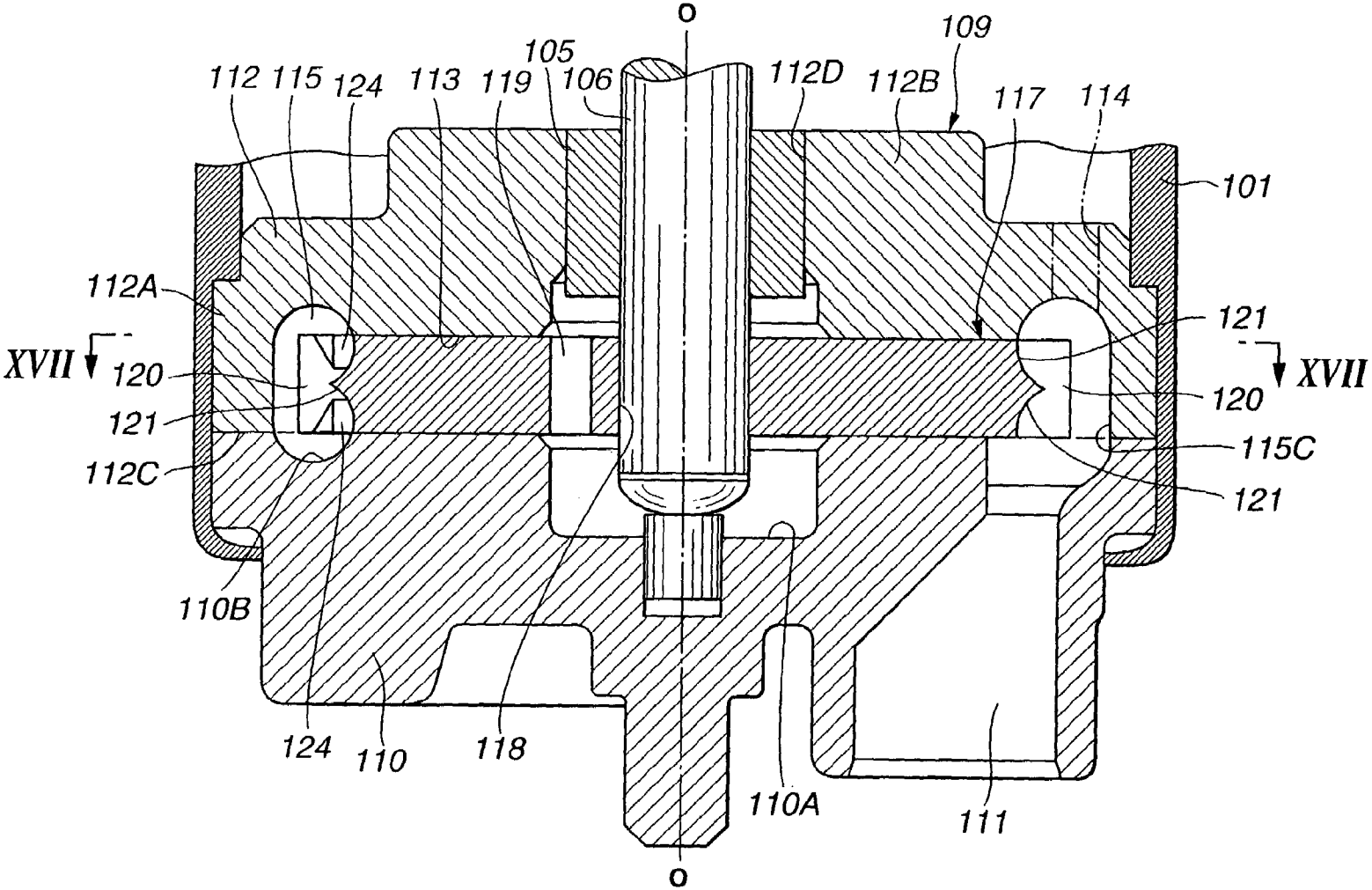
FIG. 16 is a view similar to FIG. 8, showing a main part of FIG. 15.

Referring also to FIG. 16, a bush 104 is engaged in the bearing sleeve 102C of the delivery cover 102, whereas a bush 105 is engaged in a stepped hole 112D of an inner housing 112. The bushes 104, 105 constitute a bearing for rotatably supporting a rotation shaft 106.

Figure 17:
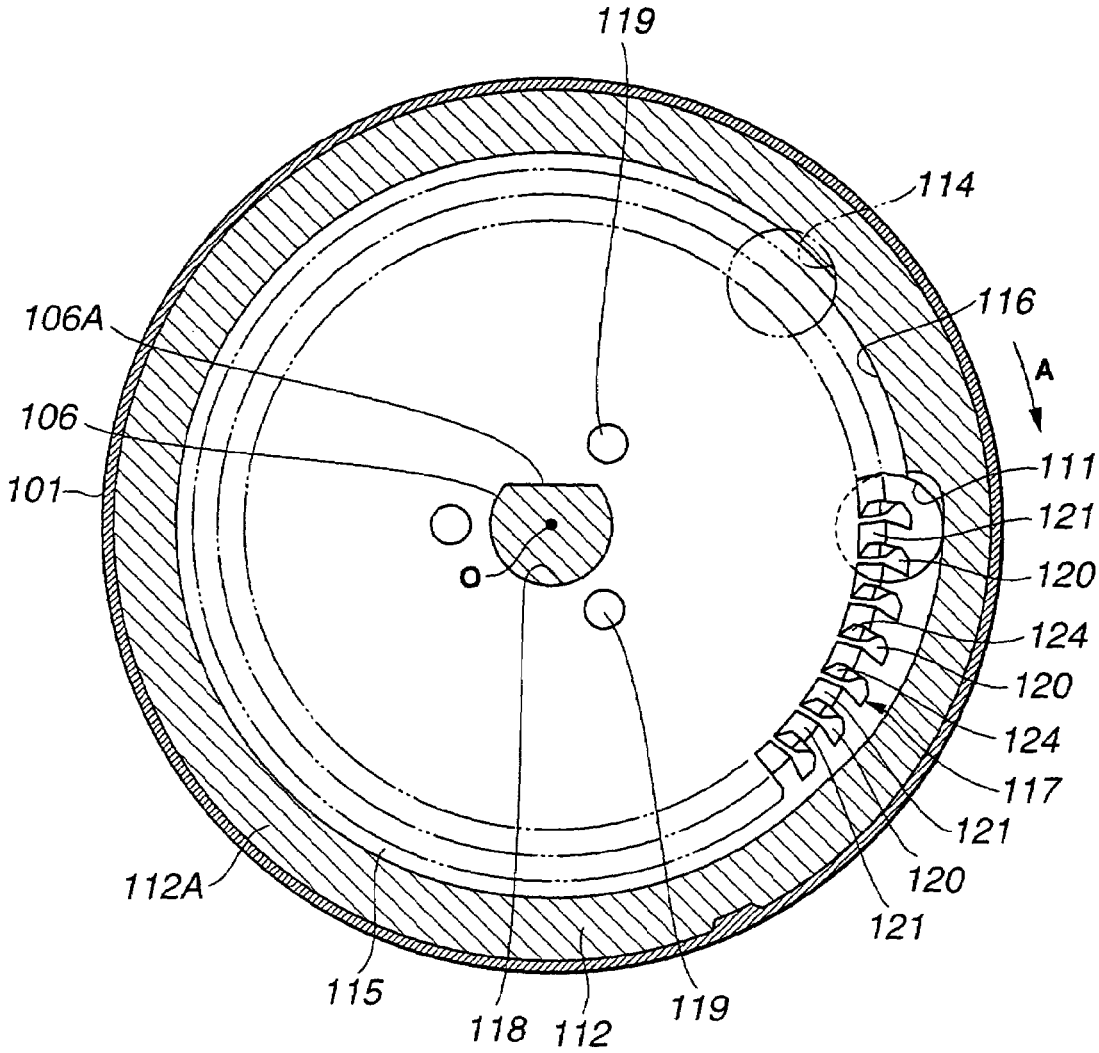
FIG. 17 is a view similar to FIG. 12, taken along the line XVII-XVII in FIG. 16.

The rotation shaft 106 is supported between the delivery cover 102 and the pump housing 109 through the bushes 104, 105. As shown in FIG. 16, the rotation shaft 106 extends axially in the casing 101 along an axis O-O to rotatably support a rotor 107B, etc. of the electric motor 107. Referring to FIG. 17, a chamfer 106A is formed at a lower end of the rotation shaft 106 to engage with an impeller 117 in the rotation-stop state.

The electric motor 107 is accommodated in the casing 101, and comprises a cylindrical yoke 107A engaged in the casing 101 between the delivery cover 102 and the pump housing 109 and for supporting a stator (not shown) comprising a permanent magnet, a rotor 107B and a commutator 107C arranged inside the yoke 107A with a clearance and mounted to the rotation shaft 106 for unitary rotation, and a pair of brushes (not shown) making slide contact with the commutator 107C.

With the electric motor 107, when energizing the rotor 107B through the connector 102B of the delivery cover 102, the brushes, and the commutator 107C, the rotor 107B is rotated together with the rotation shaft 106 to drive the impeller 117 at 5,000-8,000 rpm, for example.

A fuel passage 108 is formed between the yoke 107A and the rotor 107B of the electric motor 107, and serves to circulate to the delivery cover 102 through a clearance between the yoke 107A and the rotor 107B fuel discharged from an outlet port 114 of the pump housing 109 to the casing 101.

The pump housing 109 is arranged at another or lower end of the casing 101, and is obtained by vertically abutting an outer housing 110 and the inner housing 112. The pump housing 109 serves to rotatably accommodate the impeller 117.

As shown in FIGS. 15 and 16, the outer housing 110 of the pump housing 109 is engagedly mounted at the lower end of the casing 101 through fixing means such as calking to close the casing 101 from the outside. The outer housing 110 is integrally formed with a fuel inlet port 111.

The outer housing 110 has a circular concave 110A formed in the shaft center (axis O-O), and a circular groove 110B of substantially semicircular section formed corresponding to the outer periphery of the impeller 117 to extend circumferentially with the axis O-O as center.

The inner housing 112 is arranged on the outer housing 110, and is engaged in the casing 101 in the state abutting on the outer housing 110. As shown in FIG. 16, the inner housing 112 is shaped like a covered flat cylinder, and comprises a cylinder portion 112A for forming a cylindrical peripheral wall and a cover portion 112B for covering the cylinder portion 112A from above. The cylindrical portion 112A is formed at the inner periphery with a circular turbine accommodating recess 113 to open on the side of an abutting face 112C of the cylindrical portion 112A with the outer housing 110.

Moreover, the cylindrical portion 112A is formed at the inner periphery with an annular fuel passage 115. The cover portion 112B is formed with stepped hole 112D into which the bush 105 is inserted, and at the outer periphery with the outlet port 114 to extend vertically.

Figure 18:
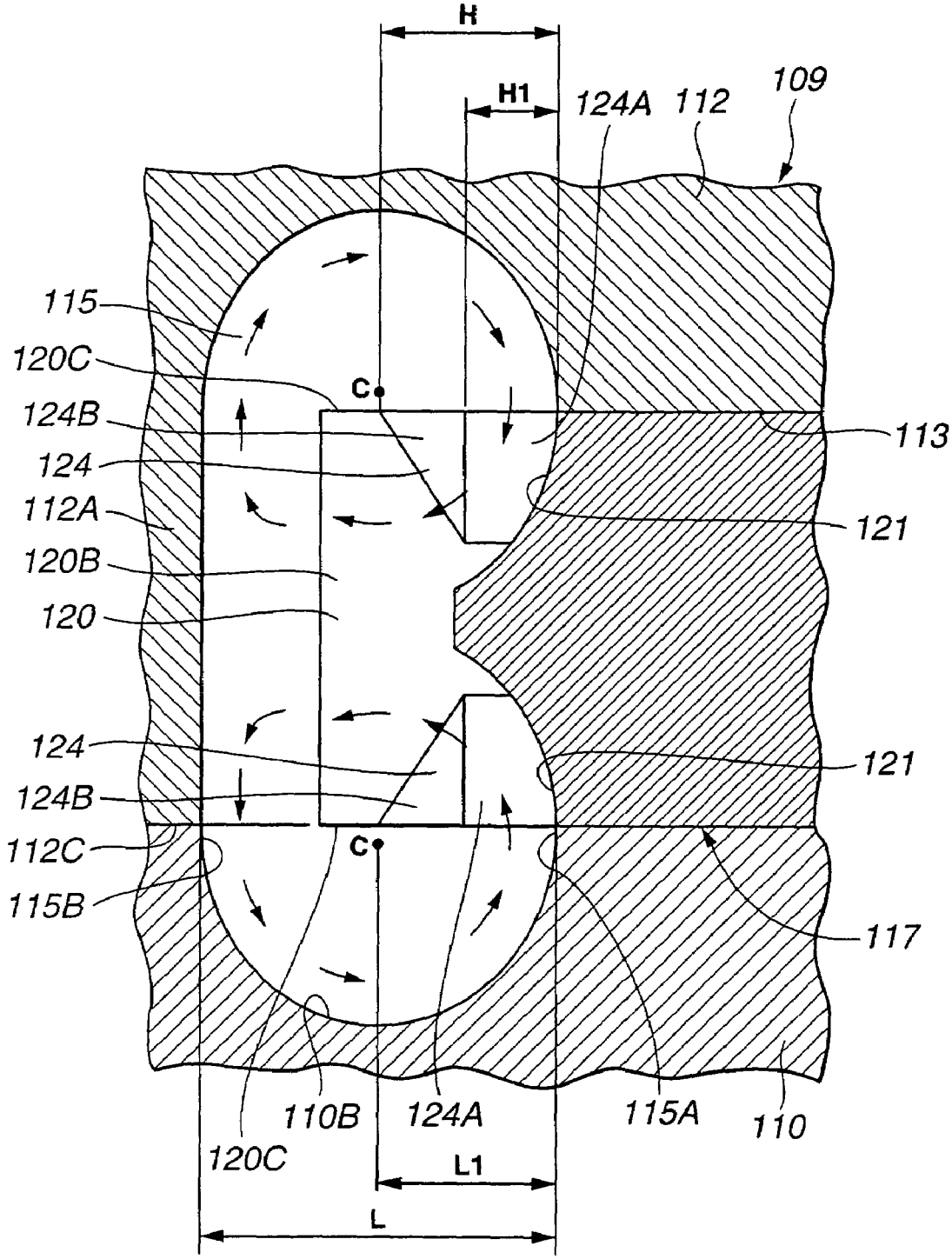
FIG. 18 is a view similar to FIG. 9, showing a main part of FIG. 17.

The fuel passage 115 is formed through the pump housing 109 at the outer periphery of the turbine accommodating recess 113 to extend circumferentially in a roughly C-shaped manner with the axis O as center as shown in FIGS. 16 and 18. The fuel passage 15 comprises circular groove 110B of the outer housing 110.

The fuel passage 115 has upper and lower ends formed circularly, along which fuel flows in a circulating manner as indicated by arrows in FIG. 18, so that the perimeter of the center of a circular portion of the fuel passage 115 forms a passage center C when fuel is fed through the fuel passage 115. The passage center C with respect to a radial length L from an internal end 115A of the fuel passage 115 to an external end 115B thereof is positioned at a distance L1 of about ½ from the internal end 115A.

The fuel passage 115 has a beginning communicating with the inlet port 111, and a termination communicating with the outlet port 114. Moreover, the fuel passage 115 includes on the beginning side an inlet passage portion 115C for smoothly introducing into the fuel passage 115 fuel sucked through the inlet port 111.

A sealing partition 116 is provided to the inner housing 112 on the side of the cylinder portion 112A. As shown in FIG. 17, the sealing partition 116 is formed as a circular protrusion protruding from the cylindrical portion 112A of the inner housing 112 to a point adjacent to the outer periphery of the impeller 117. The sealing partition 116 seals the outer periphery of the impeller 117 between the inlet port 111 and the outlet port 114, allowing fuel sucked through the inlet port 111 to surely flow along the fuel passage 115.

The impeller 117 is shaped roughly like a disk out of a reinforced plastic material, for example, and is rotatably arranged in the turbine accommodating recess 113 of the pump housing 109. The impeller 117 is rotated by the electric motor 107 in the direction of arrow A in FIG. 17 to feed fuel sucked through the inlet port 111 to the outlet port 114 through the fuel passage 115.

Figure 19:
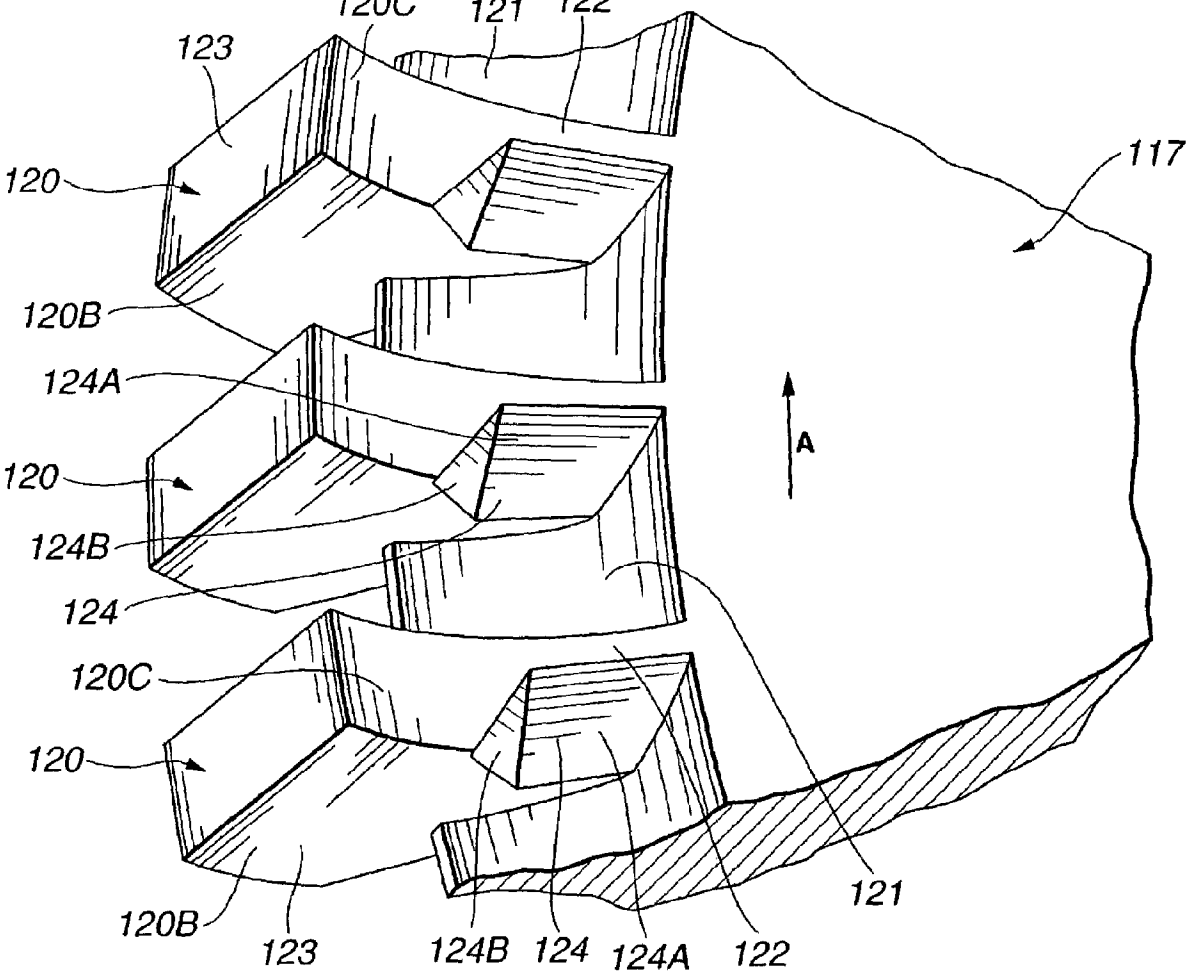
FIG. 19 is a view similar to FIG. 10, showing the blades of the impeller.

The impeller 117 has in the center of rotation (axis O-O) an engagement hole 118 in which the rotation shaft 106 is engaged. A plurality of (e.g. three) through holes 119 is arranged around the engagement hole 118. Referring to FIG. 19, the impeller 117 comprises at the outer periphery a plurality of blades 120 arranged circumferentially to extend radially. A pair of circular recesses 121 is arranged between the adjacent blades 120, each recess 121 having a curvature corresponding roughly to a circular shape of the passage 115 of the pump housing 109.

The impeller 117 is driven, together with the rotation shaft 106, by the electric motor 107 with the upper and lower faces being floating-sealed between the upper face of the outer housing 110 and the lower face of the cover portion 112B in the turbine accommodating recess 113. Each through hole 119 of the impeller 117 has a function of uniformizing the fuel pressure, etc. between the circular concave 110A of the outer housing 110 and the stepped hole 112D of the inner housing 112.

Figure 20:
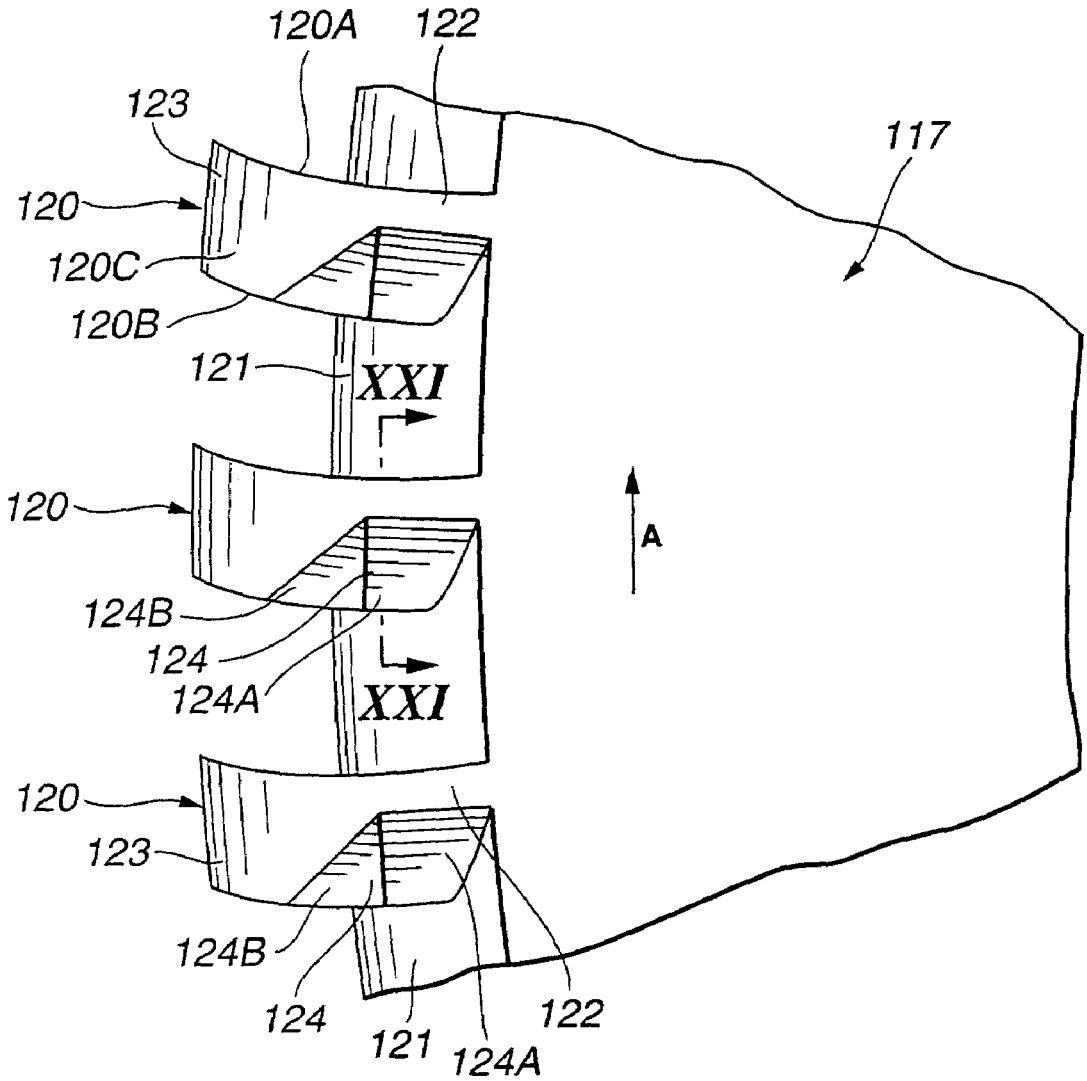
FIG. 20 is a view similar to FIG. 11, showing the blades of the impeller.

Referring to FIGS. 19 and 20, the blade 120 is formed as a plate body of substantially rectangular section comprising a front face 120A located on the forward side as viewed in the direction of rotation of the impeller 117, i.e. in the direction of arrow A, a rear face 120B located on the rearward side as viewed in the direction of rotation, and a pair of side faces 120C located between the front face 120A and the rear face 120B.

The blade 120 includes on the root side a linear blade portion 122 extending linearly in the radial direction of the impeller 117, and on the head side a curved blade portion 123 curving circularly to the forward side as viewed in the direction of rotation of the impeller 117. The linear blade portion 122 and the curved blade portion 123 are roughly half the overall length of the blade 120.

Figure 21:
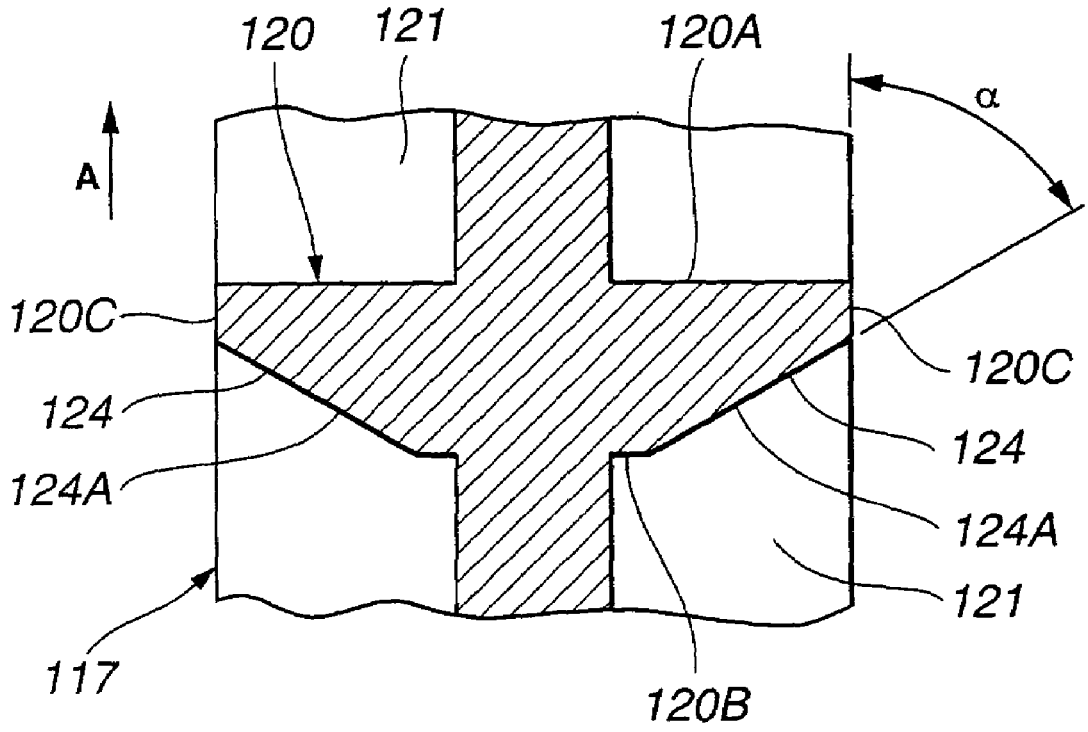
FIG. 21 is a view similar to FIG. 17, taken along the line XXI-XXI in FIG. 20.

A pair of chamfers 124 is arranged on the root side of the blade 120 to extend in the radial direction of the impeller 117. Referring to FIGS. 19-21, each chamfer 124 is obtained by slantly cutting a corner between the side face 120C and the rear face 120B of the blade 120. An overall length H of the chamfer 124 is set roughly equal to the distance L1 from the internal end 115A to the passage center C of the fuel passage 115, i.e. a value of (2/5-3/5)×L, where L is radial length of the fuel passage 31, in accordance with the following formula (11):

$$2/5 \leqq (T/L) < 3/5 \quad (11)$$

The overall length H of the chamfer 124 is set, preferably, at a value of (9/20-11/20)×L in accordance with the following formula (12):

$$9/20 \leqq (T/L) \leqq 11/20 \quad (12)$$

The overall length H of the chamfer 124 within the range given by the formulas (11) and (12) is set, optimally, at a value of ½ with respect to the radial length L of the fuel passage 115. With this, the chamfer 124 is formed to extend the passage center C which forms a center when fuel flows through the fuel passage 115 in a circulating manner, allowing the most excellent achievement of an effect of smooth fuel flow into the blade grooves between the blades 120.

The chamfer 124 comprises a roughly rectangular root-side chamfer portion 124A located on the root side and having substantially constant chamfer width, and a roughly triangular head-side chamfer portion 124B having chamfer width gradually reduced from the head of the root-side chamfer portion 124A.

The root-side chamfer portion 124A is formed by cutting a corner to have substantially constant chamfer width, achieving smooth fuel flow into the blade grooves between the blades 120 from the root side thereof, allowing a reduction in resistance to fuel flow. On the other hand, the head-side chamfer portion 124B is formed with chamfer width gradually reduced to the head thereof, achieving smooth connection between the rear face 120B and side face 120C and the root-side chamfer portion 124A, allowing smooth fuel flow therebetween.

Referring to FIG. 21, the shape of the root-side chamfer portion 124A of the chamfer 124 is described in detail. An angle of inclination a of the root-side chamfer portion 124A with respect to the side face 120C of the blade 120 is set within the range of 30-70° in accordance with the following formula (13):

$$30 \leqq \beta \leqq 70 \quad (13)$$

The angle of inclination α in the formula (13) is set, preferably, within the range of 40-60° in accordance with the following formula (14):

$$40 \leqq \beta \leqq 80 \quad (14)$$

Referring to FIG. 18, a length H1 of the root-side chamfer portion 124A with respect to the overall length H of the chamfer 124 is set at a value of (1/5-4/5)×T in accordance with the following formula (15):

$$1/5 \leqq (T1/T) \leqq 4/5 \quad (15)$$

The length H1 of the root-side chamfer portion 124A is set, preferably, at a value (2/5-3/5)×T in accordance with the following formula (16):

$$2/5 \leqq (T1/T) \leqq 3/5 \quad (16)$$

Next, operation of the third embodiment is described. When energizing the pump from the outside through the connector 102B of the delivery cover 102, a drive current is supplied to the rotor 107B of the electric motor 107 to rotate the rotor 107B and the rotation shaft 106 together, driving the impeller 117 in the pump housing 109. By rotation of the impeller 117, fuel in a fuel tank (not shown) is sucked into the fuel passage 115 through the inlet port 111, which is then fed along the fuel passage 115 by the blades 120 of the impeller 117, and discharged into the casing 101 through the outlet port 114.

Fuel discharged into the casing 101 is circulated in the casing 101 to the delivery cover 102 through the fuel passage 108, etc. so as to open the check valve 103 in the delivery pipe 102A. Then, fuel is supplied from the delivery pipe 102A to an injection valve (not shown) of the engine main body through an outside fuel line (not shown) at the delivery pressure of 200-500 kPa and the delivery rate of 30-200 L/h, for example.

Figure 22:
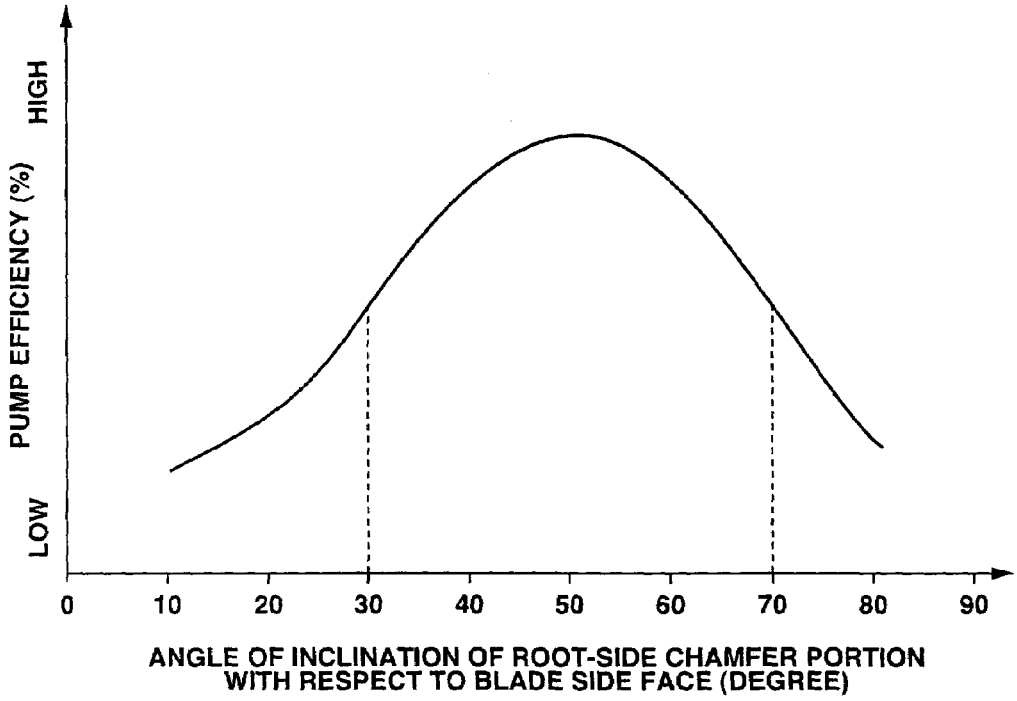
FIG. 22 is a graph similar to FIG. 14, illustrating the relationship between the angle of inclination of a root-side chamfer portion and the pump efficiency.

As a consequence of our study on the angle a of the root-side chamfer portion 124A with respect to the side face 120C of the blade 120, it is confirmed that when the angle a is set within the range of 30-70° as shown in the formula (13), preferably, within the range of 40-60° as shown in the formula (14), higher pump efficiency can be obtained as shown by a characteristic curve in FIG. 22 under the conditions of 300 kPa delivery pressure and 80 L/h delivery rate.

In this case, the ratio of the length H1 of the root-side chamfer portion 124A to the overall length H of the chamfer 124 is set at about ½. With this, the angle of inclination a of the root-side chamfer portion 124A can be set substantially equal to the flow angle of fuel running from the side face 120C of the blade 120 to the rear face 120B thereof, achieving smooth fuel flow along the root-side chamfer portion 124A, resulting in a reduction in resistance to fuel flow.

Figure 23:
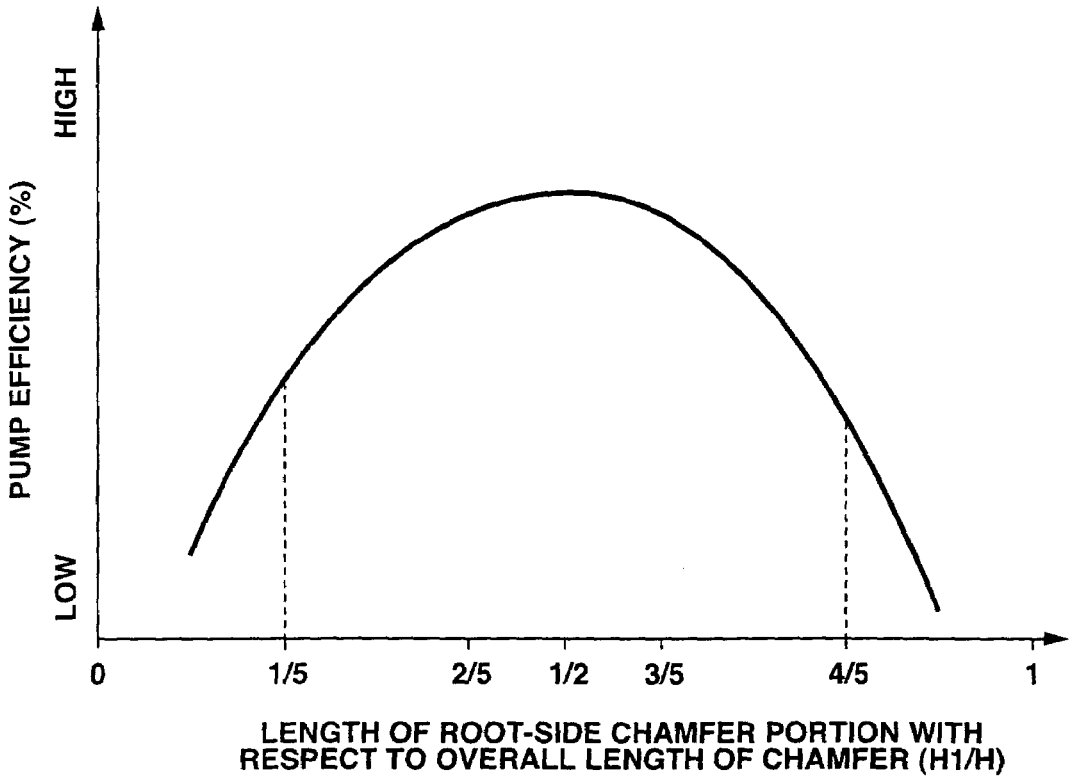
FIG. 23 is a graph similar to FIG. 22, illustrating the relationship between the length of the root-side chamfer portion and the pump efficiency.

Moreover, as a consequence of our study on the ratio of the length H1 of the root-side chamfer portion 124A to the overall length H of the chamfer 124, it is confirmed that when the ratio H1/H is set within the range of 1/5-4/5 as shown in the formula (15), preferably, within the range of 2/5-3/5 as shown in the formula (16), higher pump efficiency can be obtained as shown by a characteristic curve in FIG. 23.

In this case, the angle of inclination a of the root-side chamfer portion 124A with respect to the side face 120C of the blade 120 is set at about 50°. With this, the root-side chamfer portion 124A restrains swirls which may occur on the root side of the blade 120 through a large recess of constant width, allowing a reduction in resistance to fuel flow.

Moreover, our study reveals that since the head-side chamfer portion 124B having chamfer width gradually reduced to the head ensures smooth connection between the rear face 120B and side face 120C of the blade 120 and the root-side chamfer portion 124A, fuel can flow smoothly from the side face 120C of the blade 120 to the root-side chamfer portion 124A and from the root-side chamfer portion 124A to the rear face 120B, allowing achievement of higher pump efficiency.

In such a manner, it is revealed that when the ratio H/L of the overall length H of the chamfer 124 to the radial length L of the fuel passage 115 is set at ½ which is within the range of 9/20-11/20, the angle of inclination a of the root-side chamfer portion 124A with respect to the side face 120C of the blade 120 is set at 50° which is within the range of 40-60°, and the ratio H1/H of the length H1 of the root-side chamfer portion 124A to the overall length H of the chamfer 124 is set at ½ which is within the range of 2/5-3/5, the highest pump efficiency can be obtained.

In the third embodiment, the chamfer 124 obtained by slantly cutting a corner between the side face 120C and the rear face 120B is arranged on the side of the impeller 32. And the chamfer 124 is designed such that the overall length H extending in the radial direction of the impeller 117 is set at 9/20-11/20 (preferably, ½) with respect to the radial length L of the fuel passage 115, the angle of inclination α of the root-side chamfer portion 124A with respect to the side face 120C of the blade 120 is set at 40-60° (preferably, 50°), and the length H1 of the root-side chamfer portion 124A is set at ⅖-⅗ (preferably, ½) with respect to the overall length H of the chamfer 124.

Thus, in the third embodiment, the position and length of the chamfer 124 (root-side chamfer portion 124A) and the angle of inclination of the root-side chamfer portion 124A can be set to correspond to the inflow position of fuel flowing into the blade grooves between the blades 120 through the fuel passage 115, the size required for smooth fuel inflow, and the angle allowing smooth fuel inflow.

As a result, when rotating the impeller 117, the chamfer 124 allows smooth fuel flow along the root-side chamfer portion 124A and the head-side chamber portion 124B to reduce the resistance to fuel flow, achieving efficient feeding of fuel to the outlet port 114 through the fuel passage 115, leading to enhancement in the pump efficiency.

Figure 24:
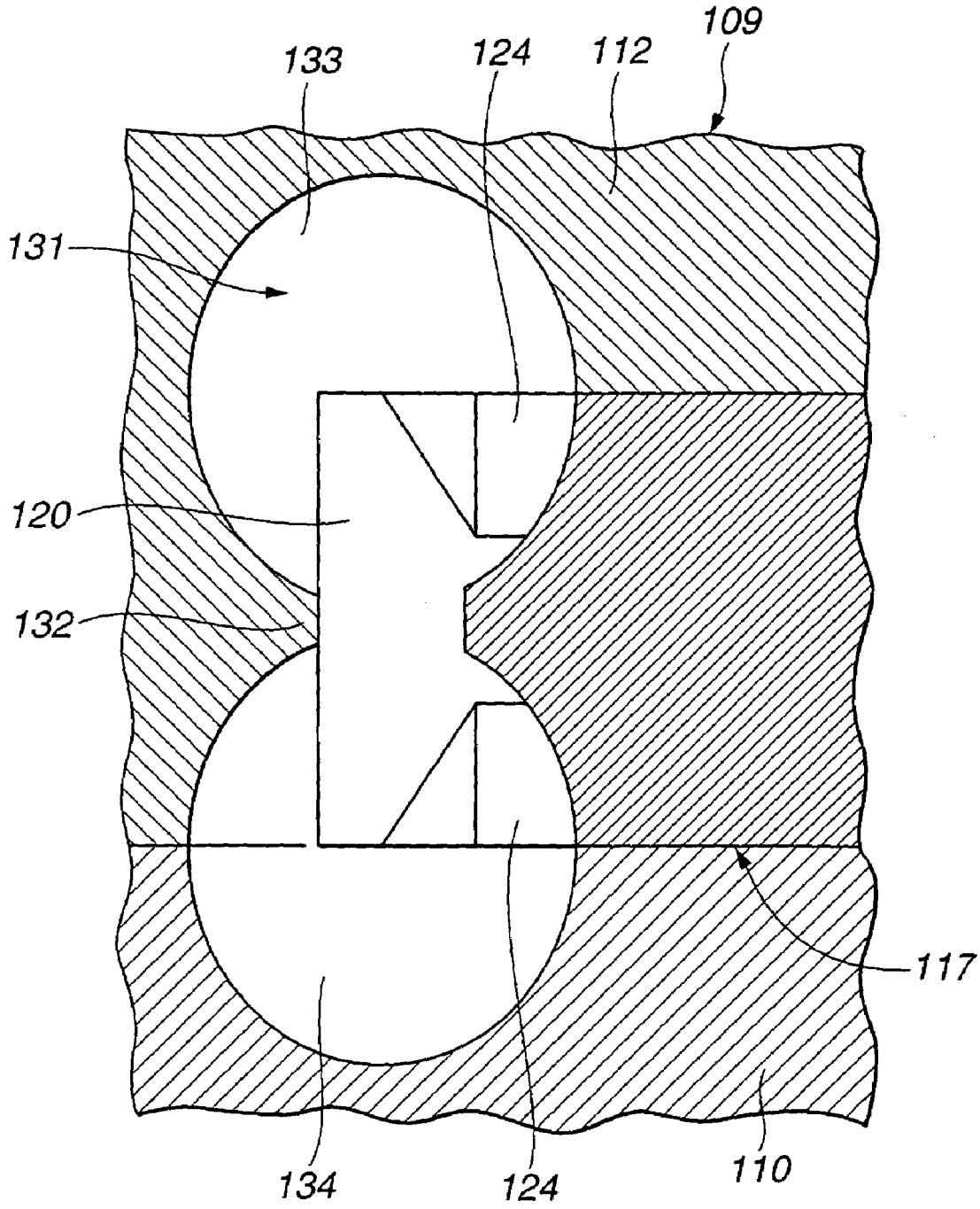
FIG. 24 is a view similar to FIG. 18, showing a first variation of the third embodiment.

In the third embodiment, the fuel passage 115 is formed as a passage of larger vertical length and C-shaped section. Optionally, referring to FIG. 24, in a first variation, a fuel passage 131 may comprise two portions divided vertically by annular protrusions 132 protruding radially inward from the center of the fuel passage 132, i.e. an interior passage 133 and the abutting-side passage 134.

Figure 25:
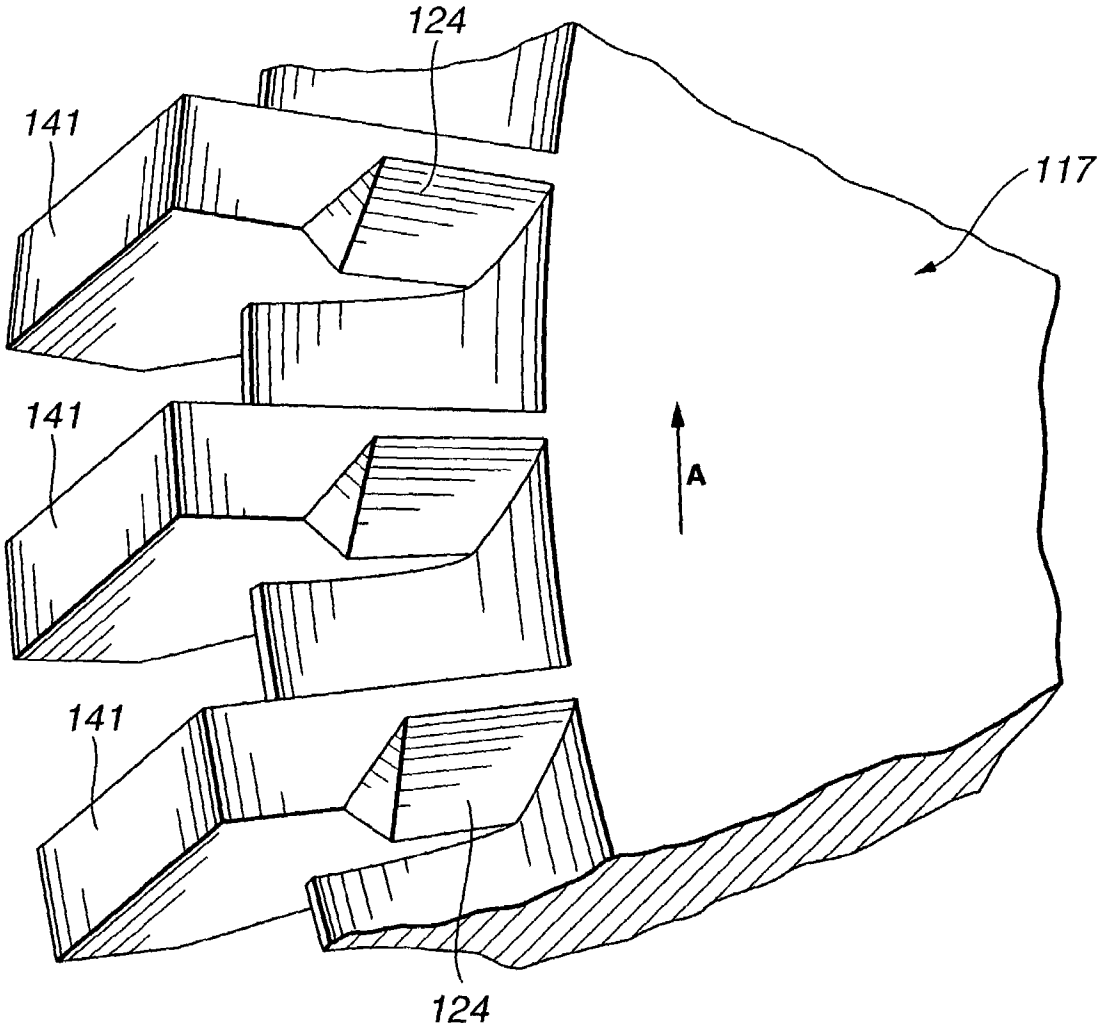
FIG. 25 is a view similar to FIG. 19, showing a second variation of the third embodiment.

Further, in the third embodiment, each blade 120 of the impeller 117 includes on the root side linear blade portion 122 extending linearly in the radial direction of the impeller 117, and on the head side curved blade portion 123 curving circularly to the forward side as viewed in the direction of rotation of the impeller 117. Optionally, referring to FIG. 25, in a second variation, each blade 141 may include a linear structure extending linearly from the root to the head. Alternatively, the blade 120 may include a curved structure curved from the root to the head circularly forward in the direction of rotation.

Having described the present invention with regard to the illustrative embodiments, it is noted that the present invention is not limited thereto, and various changes and modifications can be made without departing from the scope of the present invention.

The entire teachings of Japanese Patent Application P2002-257988 filed Sep. 3, 2002 and Japanese Patent Application P2002-165946 filed Jun. 6, 2002 are hereby incorporated by reference.

What is claimed is:

1. A turbine fuel pump, comprising:

a casing for accommodating an electric motor;

a housing provided to the casing, the housing comprising an annular passage between inlet and outlet ports; and an impeller rotatably arranged in the housing, the impeller comprising blades arranged on an outer periphery to extend in a radial direction of the impeller and feeding fuel through the passage while the blades are rotated by the electric motor, each blade including a plate body of substantially rectangular section, the plate body comprising a front face located on the forward side of the impeller, a rear face located on a rearward side of the impeller, and a pair of side faces located between the front face and the rear face, each blade comprising a chamfer arranged on the root side of the blade to extend in the radial direction of the impeller, the chamfer being obtained by slantly cutting a corner between the side face and the rear face of the blade, the chamfer having a predetermined overall length, wherein the predetermined overall length is (⅖ to ⅗)×L, where L is a radial length of the passage, wherein the chamfer comprises a root-side portion and a head-side portion, wherein the root-side portion has a substantially constant chamfer width and a predetermined length, and the head side portion has a chamfer width gradually reduced from a head of the root-side portion so as to achieve smooth connection between the rear face and the side face, wherein the predetermined length of the root-side portion is (⅕ to ⅘)×T, where T is the predetermined overall length of the chamfer.

2. The turbine fuel pump as claimed in claim 1, wherein the predetermined length of the chamfer is (9/20 to 11/20)×L.

3. The turbine fuel pump as claimed in claim 1, wherein the predetermined length of the root-side portion is (⅖ to ⅗)×T.

4. The turbine fuel pump as claimed in claim 3, wherein the root-side portion has a predetermined angle of inclination with respect to the side face of the blade, wherein the predetermined angle is 30 to 70°.

5. The turbine fuel pump as claimed in claim 4, wherein the predetermined angle of inclination of the root-side portion is 40 to 60°.

6. A turbine fuel pump comprising:

a casino for accommodating an electric motor;

a housing provided to the casing, the housing comprising an annular passage between inlet and outlet ports; and an impeller rotatably arranged in the housing, the impeller comprising blades arranged on an outer periphery to extend in a radial direction of the impeller and feeding fuel through the passage while the blades are rotated by the electric motor, each blade including a plate body of substantially rectangular section, the plate body comprising a front face located on the forward side of the impeller, a rear face located on a rearward side of the impeller, and a pair of side faces located between the front face and the rear face, each blade comprising a chamfer arranged on the root side of the blade to extend in the radial direction of the impeller, the chamfer being obtained by slantly cutting a corner between the side face and the rear face of the blade, the chamfer having a predetermined length, wherein the chamfer comprises a root-side portion and a head-side portion, wherein the root-side portion has a substantially constant chamfer width and a predetermined length, and the head side portion has a chamfer width gradually reduced from a head of the root-side portion, wherein the root-side portion has a predetermined angle of inclination with respect to the side face of the blade, wherein the predetermined length of the chamfer is ½×L where L is a radial length of the passage, the predetermined length of the-root-side portion is ½×T where T is the predetermined length of the chamfer, and the predetermined angle of inclination of the root-side portion is 50°.

7. A turbine fuel pump, comprising a casing for accommodating an electric motor;

a housing provided to the casing, the housing comprising an annular passage between inlet and outlet ports; and an impeller rotatably arranged in the housing, the impeller comprising blades arranged on an outer periphery to extend in a radial direction of the impeller and feeding fuel through the passage while the blades are rotated by the electric motor, each blade including a plate body of substantially rectangular section, the plate body comprising a front face located on the forward side of the impeller, a rear face located on a rearward side of the impeller, and a pair of side faces located between the front face and the rear face, each blade comprising a chamfer arranged on the root side of the blade to extend in the radial direction of the impeller, the chamfer being obtained by slantly cutting a corner between the side face and the rear face of the blade, wherein the chamfer comprises a root-side portion and a head-side portion, wherein the root-side portion has a substantially constant chamfer width and a predetermined length, and the head side portion has a chamfer width gradually reduced from a head of the root-side portion so as to achieve smooth connection between the rear face and the side face, wherein the predetermined length of the root-side portion is (1/5 to 4/5)×T, where T is an overall length of the chamfer.

* * * * *